US012290095B1

(12) United States Patent
Sharmoug

(10) Patent No.: US 12,290,095 B1
(45) Date of Patent: May 6, 2025

(54) CIGARETTE ROLLER WITH FIXED ROTATING END CAP AND GEAR BARRIER PROTECTION

(71) Applicant: Zaina Co. Corporation, Manteca, CA (US)

(72) Inventor: Ghassan Sharmoug, Manteca, CA (US)

(73) Assignee: Zaina Co. Corporation, Manteca, CA (US)

( * ) Notice: Subject to any disclaimer, the term of this patent is extended or adjusted under 35 U.S.C. 154(b) by 442 days.

(21) Appl. No.: 17/981,379

(22) Filed: Nov. 4, 2022

Related U.S. Application Data

(63) Continuation-in-part of application No. 17/339,575, filed on Jun. 4, 2021, now abandoned.

(51) Int. Cl.
*A24C 5/44* (2006.01)

(52) U.S. Cl.
CPC ..... *A24C 5/44* (2013.01)

(58) Field of Classification Search
CPC ..... A24C 5/20; A24C 5/18
See application file for complete search history.

(56) References Cited

FOREIGN PATENT DOCUMENTS

BE 904701 A * 8/1986 ..... A24C 5/10

* cited by examiner

*Primary Examiner* — Michael H. Wilson
*Assistant Examiner* — Jennifer A Kessie
(74) *Attorney, Agent, or Firm* — Adibi IP Group, PC; Amir V. Adibi; Andrew C. Palmer

(57) ABSTRACT

A cigarette roller comprises two roller holders each containing a plurality of rollers, attached via a hinge and an end cap. The rollers and end cap are each attached to a gear. The cigarette roller is configurable in an open or closed position. The end cap rotates in a fixed position and engages gears of the rollers. Gear barriers are included that provide physical separation between gears and non-slip surfaces of each roller thereby reducing the likelihood of gears getting clogged during operation of the cigarette roller. During operation, a user opens the device, inserts smoking material, inserts wrapping material, closes the device, rotates the end cap which rotates the rollers, opens the device, and removes a cigarette.

20 Claims, 26 Drawing Sheets

CIGARETTE ROLLER CROSS SECTION
(END CAP EXTENDED)

CIGARETTE ROLLER

CIGARETTE ROLLER

END VIEW OF CIGARETTE ROLLER (OPEN)

END VIEW OF CIGARETTE ROLLER (CLOSED)

END VIEW OF CIGARETTE ROLLER (OPEN)

END VIEW OF CIGARETTE ROLLER (CLOSED)

SIDE VIEW OF CIGARETTE ROLLER (OPEN)

TOP VIEW OF CIGARETTE ROLLER (OPEN)

BOTTOM VIEW OF CIGARETTE ROLLER (OPEN)

TOP VIEW OF CIGARETTE ROLLER (CLOSED)

FRONT VIEW OF CIGARETTE ROLLER (CLOSED)

ROLLING STEP A

ROLLING STEP B

ROLLING STEP C

ROLLING STEP D

ROLLING STEP E

ROLLING STEP F

ROLLING STEP G

CIGARETTE ROLLER WITH ANNULAR GEAR END CAP

CIGARETTE ROLLER CROSS SECTION
(END CAP EXTENDED)

CIGARETTE ROLLER CROSS SECTION
(END CAP RETRACTED)

CIGARETTE ROLLER WITH GEAR BARRIERS AND END CAP WITHOUT SPRING

CROSS SECTIONAL VIEW OF GEAR BARRIER SEPARATING GEARS FROM NON-SLIP SURFACES

CIGARETTE ROLLER WITH END CAP IN FIXED POSITION (CLOSED CONFIGURATION)

BOTTOM VIEW OF CIGARETTE ROLLER WITH END CAP IN FIXED POSITION (CLOSED CONFIGURATION)

TOP VIEW OF CIGARETTE ROLLER WITH END CAP IN FIXED POSITION (CLOSED CONFIGURATION)

LEFT SIDE VIEW OF CIGARETTE ROLLER WITH END CAP IN FIXED POSITION (CLOSED CONFIGURATION)

RIGHT SIDE VIEW OF CIGARETTE ROLLER WITH END CAP IN FIXED POSITION (CLOSED CONFIGURATION)

BACK END VIEW OF CIGARETTE ROLLER WITH END CAP IN FIXED POSITION (CLOSED CONFIGURATION)

FRONT END VIEW OF CIGARETTE ROLLER WITH END CAP IN FIXED POSITION (CLOSED CONFIGURATION)

CIGARETTE ROLLER WITH FIXED ROTATING END CAP AND GEAR BARRIER PROTECTION

CROSS-REFERENCE TO RELATED APPLICATIONS

This application is a continuation-in-part of, and claims the benefit under 35 U.S.C. § 120 from, nonprovisional U.S. patent application Ser. No. 17/339,575, entitled "Cigarette Roller", filed Jun. 4, 2021, the subject matter of which is incorporated herein by reference.

TECHNICAL FIELD

The present invention relates generally to smoking equipment, and more specifically, to cigarette rollers.

BACKGROUND INFORMATION

Many methods exist for consuming various smokable materials. A cigarette is one technique used to consume smokable materials. One type of commonly available cigarette is a pre-rolled and filtered cigarette. Another popular type of cigarette is one that is prepared and rolled by an end consumer. In this variety of cigarettes, smoking material such as tobacco is rolled within rolling paper to form the cigarette. The rolled cigarette is then smoked by the end consumer.

SUMMARY

A cigarette roller comprises two roller holders and an end cap. The roller holders are attached together via a hinge. Each of the roller holders contains at least one roller. The cigarette roller is operable to receive a variety of smoking materials and wrapping materials and rotate the rollers to wrap the wrapping material about the smoking material to form a cigarette. The cigarette roller is configurable into an open position and closed position. The end cap is configurable in an extended position that allows the cigarette roller to transition from open to closed and vice versa. The end cap is also configurable into a retracted position that locks the cigarette roller in the closed position. A user is able to conveniently store and transport the cigarette roller without it undesirably opening and closing. The end cap also provides a user an easy means to grip and rotate the end cap. In one embodiment, the end cap includes a non-slip outer surface. In another embodiment, the end cap has a series of grooves, impressions, or another non-smooth texture to provide additional grip. The end cap also encloses the gear mechanism, eliminating a pinch point that could cause injury to a user.

To use the cigarette roller, a user extends the end cap into an extended position and opens the cigarette roller into an open position. The user inserts smoking material and wrapping material into an interior of the cigarette roller. Next, the user closes the cigarette roller into a closed position and retracts the end cap into a retracted position. Next, the user rotates the end cap, causing the rollers to rotate. As the rollers rotate, the wrapping material wraps around the smoking material thereby forming a cigarette. Next, the user extends the end cap into the extended position, opens the cigarette roller into the open position, and removes the cigarette. In some embodiments, the smoking material is optionally rolled in the cigarette roller in a preliminary step prior to inserting the wrapping material into the cigarette roller and rolling the wrapping material about the smoking material.

The cigarette roller is configurable in an open or closed position. In the open position, the inner cavity of the cigarette roller is accessible and the rollers are visible. The hollow portion of the first roller holder and the hollow portion of the second roller holder are not adjacent when in the open position. In the closed position, the inner cavity of the cigarette roller is enclosed and not accessible. The rollers are not visible in the closed position. The hollow portion of the first roller holder and the hollow portion of the second roller holder are adjacent to each other in the closed position. A notch cut into the first roller holder and a notch cut into the second roller holder meet to form a slot. Paper is passed through the slot when the cigarette roller is in use. The first roller holder includes an opening in the base to allow unwrapped smoking material to escape the cigarette roller. This opening prevents unwrapped smoking material from impeding the motion of the rollers.

In one embodiment, a roller is a thin and long cylinder with a gear at a first end and an axle at a second end. The second end is opposite the first end. Each roller rotates about a central axis parallel to the length of the roller. Rollers extend from one end of the roller holder proximate to the end cap, to the opposite end of the roller holder. The gear attached to a roller extends from the end of the roller holder proximate to the end cap. Rollers have a non-slip outer surface or a surface with a series of ridges running parallel to the central axis. Rollers are positioned parallel to one another within the first and second roller holders. Rollers are positioned such that no two adjacent rollers touch, and no roller touches the inner surface of the roller holder within which it is disposed.

The end cap is configurable in an extended position or in a retracted position. The end cap includes a gear. The gear connects to the end cap via a shaft. In one embodiment, the end cap is spring-loaded to be in the retracted position. In another embodiment, the end cap is spring-loaded to be in the extended position. In the retracted position, the end cap gear engages at least one gear connected to a roller and the end cap at least partially encloses at least one gear connected to a roller. In the extended position, the end cap is disposed a distance away from but still connected to the first roller holder via a shaft and does not enclose any gear connected to a roller. When the cigarette roller is closed and the end cap is in the retracted position, the end cap holds the cigarette roller in the closed position by enclosing the gears that are connected to rollers. This is beneficial because in this configuration where the cigarette roller is closed and the end cap is retracted, the cigarette roller will not undesirably open.

In the retracted position, the end cap at least partially encloses the gears connected to the rollers and the end cap gear. When the end cap gear is retracted, it is in contact with at least one gear connected to a roller. When the end cap is in the retracted position and the end cap rotates, the end cap gear rotates in the same direction. When the end cap is rotated in a first direction, the gear connected to the roller rotates in a second direction opposite the first direction. The end cap enclosing the gears protects the gears from debris or other interference and eliminates a pinch point (also called a nip point) that may injure a user. This pinch point could catch on a user's hair, jewelry, or loose clothing and drag it into the gears.

In another embodiment, the end cap is temporarily lockable in an extended position against the force of the spring.

The end cap is spring-loaded to remain in the retracted position and the user exerts a force on the end cap to pull the end cap away from the first roller holder into the extended position. The user continues to pull the end cap away from the first roller holder until the locking mechanism engages. To disengage the locking mechanism, the user pushes the end cap towards the first roller holder until the locking mechanism disengages and the spring forces the end cap back to the retracted position. In another embodiment, the locking mechanism requires the end cap to be turned in order to engage. In another embodiment, the locking mechanism requires a lever, latch, or other mechanical means to be manipulated.

In another embodiment, the end cap is spring loaded to be in the extended position, and the end cap is temporarily lockable in the retracted position against the force of the spring. The end cap is spring-loaded to remain in the extended position and the user exerts a force on the end cap to push the end cap toward the first roller holder into the retracted position. The user continues to push the end cap toward the first roller holder until the locking mechanism engages. To disengage the locking mechanism, the user pulls the end cap away from the first roller holder until the locking mechanism disengages and the spring forces the end cap back to the extended position. In another embodiment, the locking mechanism requires the end cap to be turned in order to engage. In another embodiment, the locking mechanism requires a lever, latch, or other mechanical means to be manipulated.

In one embodiment, the end cap gear is a spur gear. In another embodiment, the end cap gear is an annular (ring) gear attached to or formed from the inner surface of the end cap. The annular gear is functionally similar to a spur gear.

In another embodiment, a cigarette roller is provided with an end cap that rotates in a fixed position and includes gear barriers in each roller holder. The end cap mechanism does not involve any spring that allows retraction, extension, or locking. Providing the end cap at fixed position promotes functionality of single-handed operation and reduces manufacturing complexity as compared to embodiments having springs or retracting end caps. The gear barriers provide physical separation between gears and non-slip surfaces of each roller. The gear barriers reduce the likelihood of gears getting clogged during operation of the cigarette roller.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

In the description and claims, terms such as "clockwise (CW)", "counterclockwise (CCW)", "top", "bottom", "front", "back", and "side" are used to describe relative directions and orientations between different parts of the cigarette roller, and it is to be understood that the overall structure being described can actually be oriented in any way in three-dimensional space. For example, when a first object is described as rotating counterclockwise, it is to be understood that the first object may in fact be rotating clockwise when viewed from a different perspective.

Figure 1:
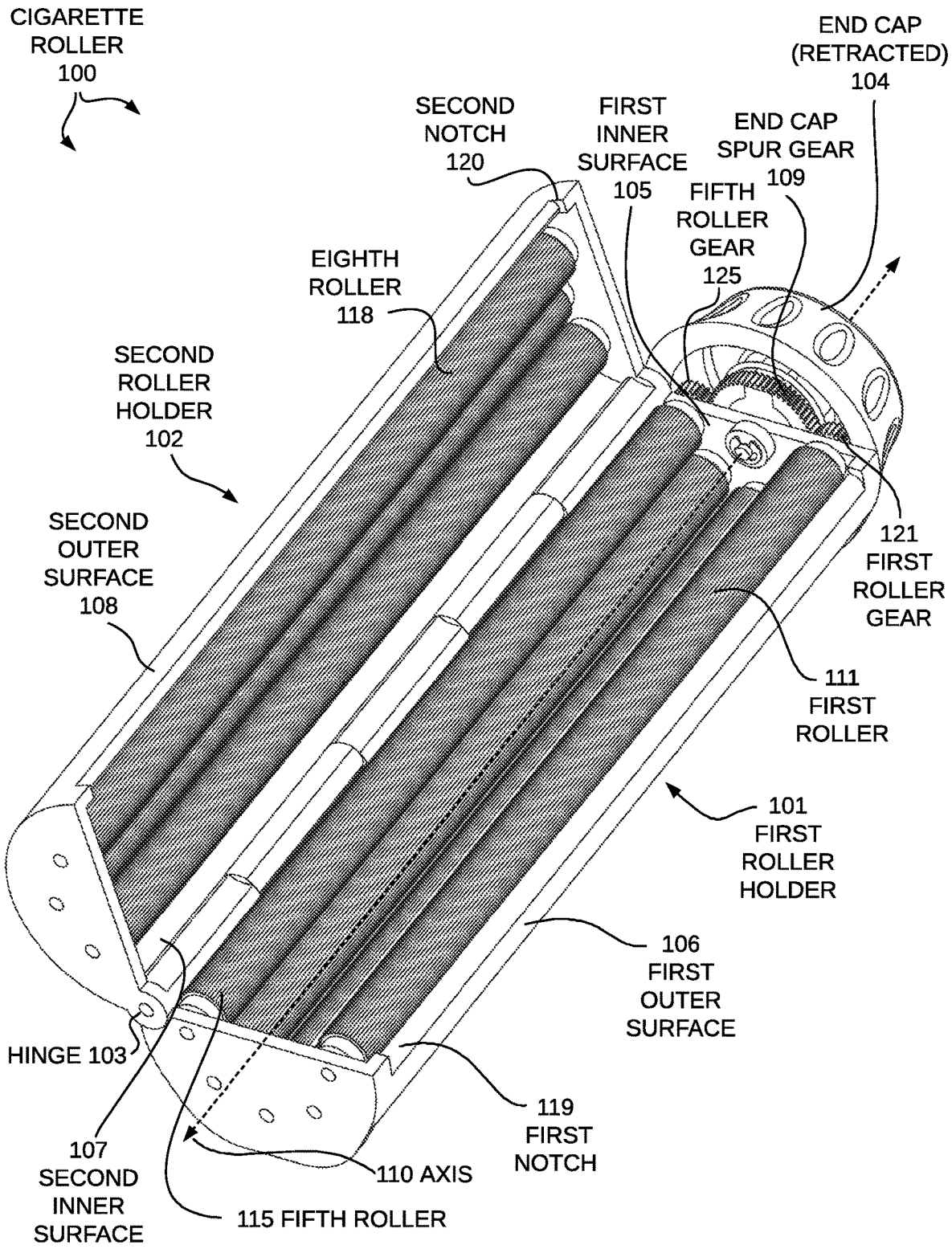
FIG. 1 is a diagram showing a perspective view of cigarette roller 100.

FIG. 1 is a diagram of a perspective view of cigarette roller 100. The cigarette roller 100 comprises a first roller holder 101, a second roller holder 102, a hinge 103, an end cap 104, a first plurality of rollers 111-115, and a second plurality of rollers 116-118.

The first roller holder 101 comprises a hollow body with a first inner surface 105, a first outer surface 106, and rollers 111-115. The first roller holder 101 has a first end and a second end opposite the first end. The first roller holder 101 includes a first notch 119. First notch 119 is opposite hinge 103. First notch 119 extends along at least the majority of the length between the first end and second end of the first roller holder 101. The depth of first notch 119 is less than or equal to the radius of a roller.

The first plurality of rollers 111-115 comprises five rollers. Rollers 111-115 are cylinders wherein the length (or height) of the cylinder is greater than the diameter of the cylinder. Each roller has an axis that extends through the center of a first circular cross-section of the roller and through the center of a second circular cross-section of the roller. Each roller rotates about the axis of the roller. Rollers 111-115 extend from the first end of the first roller holder 101 to the second end of the first roller holder 101. Rollers 111-115 are arranged within the hollow space of the first roller holder 101 parallel to one another. Rollers 111-115 are placed such that the distance between the first inner surface 105 of first roller holder 101 and the outer surface of any of the rollers 111-115 is less than the diameter of a roller. The rollers 111-115 are arranged such that the distance between the outer surfaces of any two adjacent rollers 111-115 is less than the diameter of a roller. The spacing between the first inner surface 105 of the first roller holder 101 and any of the rollers 111-115 allows the cigarette roller 100 to remain as compact as possible. The adjacent spacing between each of the rollers 111-115 reduces the amount of smoking material 130 entering the space between any two adjacent rollers 111-115. Roller gears 121-125 protrude from the outer surface of the first end of the first roller holder 101. Roller gears 121-125 are circular spur gears. Roller gears 121-125 are coaxial with the axis of the roller to which the gear is attached.

The second roller holder 102 comprises a hollow body with a second inner surface 107, a second outer surface 108, and rollers 116-118. The second roller holder 102 has a first end, and a second end opposite the first end. The second roller holder 102 includes a second notch 120. Second notch 120 is opposite hinge 103. Second notch 120 extends along at least the majority of the length between the first end and second end of the second roller holder 102. The depth of second notch 120 is less than or equal to the radius of a roller.

The second plurality of rollers 116-118 comprises three rollers. Rollers 116-118 are cylinders wherein the length (or height) of the cylinder is greater than the diameter of the cylinder. Each roller has an axis that extends through the center of a first circular cross-section of the roller and through the center of a second circular cross-section of the roller. Each roller rotates about the axis of the roller. Rollers 116-118 extend from the first end of the second roller holder 102 to the second end of the second roller holder 102. Rollers 116-118 are arranged within the hollow space of the second roller holder 102 parallel to one another. Rollers 116-118 are placed such that the distance between the second inner surface 107 of second roller holder 102 and the outer surface of any of the rollers 116-118 is less than the diameter of a roller. The rollers 116-118 are arranged such that the distance between the outer surfaces of any two adjacent rollers 116-118 is less than the diameter of a roller. The spacing between the inner surface 107 of the second roller holder 102 and any roller 116-118 allows the cigarette roller 100 to remain as compact as possible. The spacing between each of the rollers 116-118 reduces the amount of smoking material 130 that enters the space between any two adjacent rollers 116-118. Roller gears 126-128 protrude from the outer surface of the first end of the second roller holder 102. Roller gears 126-128 are circular spur gears. Roller gears 126-128 are coaxial with the axis of the roller to which the gear is attached.

In the embodiment shown in FIG. 1, there are two pluralities of rollers: a first plurality of rollers 111-115, and a second plurality of rollers 116-118. When combined, the two pluralities amount to a total of eight rollers 111-118. In one embodiment, each of the rollers 111-118 has an outer surface made of a non-slip material. In another embodiment, each of the rollers 111-118 has an outer surface with ridges arranged parallel to the axis of the roller. In yet another embodiment, each of the rollers 111-118 has an outer surface with a pattern of ridges and/or valleys. Roller gear 121 is attached to the first end of roller 111. Roller gear 122 is attached to the first end of roller 112. Roller gear 123 is attached to the first end of roller 113. Roller gear 124 is attached to the first end of roller 114. Roller gear 125 is attached to the first end of roller 115. Roller gear 126 is attached to the first end of roller 116. Roller gear 127 is attached to the first end of roller 117. Roller gear 128 is attached to the first end of roller 118. The second end of each roller 111-118 is an axle. For clarity, rollers may be referred to as "first roller 111, second roller 112 . . . eighth roller 118" in some cases. For clarity, roller gears may be referred to as "first roller gear 121, second roller gear 122 . . . eighth roller gear 128" in some cases. In another embodiment, there are less than eight, but at least two rollers. In yet another embodiment, there are at least 9 rollers.

The first roller holder 101 and the second roller holder 102 are attached via hinge 103. The first end of the first roller holder 101 is in the same plane as the first end of the second roller holder 102. In one embodiment, the first roller holder 101 and the second roller holder 102 are permanently attached via the hinge 103. In another embodiment, roller holder 101 and roller holder 102 are detachable at the hinge 103.

End cap 104 is connected to the first end of the first roller holder 101 via a shaft. The shaft terminates at shaft end 136 (see FIGS. 5-6). End cap 104 has an axis 110 through the center. End cap spur gear 109 is attached to the shaft of end cap 104 and is coaxial with axis 110. End cap 104 provides a user an easy means to grip and rotate the end cap. End cap 104 has a series of impressions disposed around the circumference of the outer surface. In another embodiment, the end cap includes a non-slip outer surface, a series of ridges, or other non-smooth features to provide additional grip. End cap 104 is positionable in an extended position or a retracted position.

The cigarette roller 100 is positionable in an open or closed position. End cap 104 is positionable in an extended position or a retracted position. When cigarette roller 100 is in the closed position, the hollow portion of the first roller holder 101 and the hollow portion of the second roller holder 102 are adjacent. In the closed position, first notch 119 and second notch 120 are adjacent and form slot 133. When the cigarette roller 100 is in the open position, the hollow portion of the first roller holder 101 and the hollow portion of the second roller holder 102 are not adjacent. When the cigarette roller 100 is in the open position and end cap 104 is in the retracted position, end cap spur gear 109 engages roller gears 121-125. The roller gears 121-125 do not engage with one another. When the cigarette roller 100 is in the closed position and end cap 104 is in the retracted position, end cap spur gear 109 engages roller gears 121-128. The roller gears 121-128 do not engage with one another.

When end cap 104 is in the extended position, end cap 104 is disposed a distance away from but still connected to the first end of the first roller holder 101 via the shaft of end cap 104. The distance between end cap 104 and first roller holder 101 is greater than the thickness of any of the roller gears 126-128. When the cigarette roller 100 is in the open position and end cap 104 is in the retracted position, end cap 104 at least partially encloses roller gears 121-125. When the cigarette roller 100 is in the closed position and the end cap 104 is in the retracted position, end cap 104 at least partially encloses roller gears 121-128. When cigarette roller 100 is in the open position, end cap 104 is in the retracted position, and end cap 104 rotates in a first direction, end cap spur gear 109 engages roller gears 121-125 and rollers 111-115 rotate in a second direction opposite the first direction. In the retracted state, end cap 104 provides clearance to allow roller gears 121-125 to rotate freely. When cigarette roller 100 is in the closed position, end cap 104 is in the retracted position, and end cap 104 rotates in the first direction, end cap spur gear 109 engages roller gears 121-128 and rollers 111-118 rotate in the second direction. In the retracted state, end cap 104 provides clearance to allow roller gears 121-128 to rotate freely.

Figure 2:
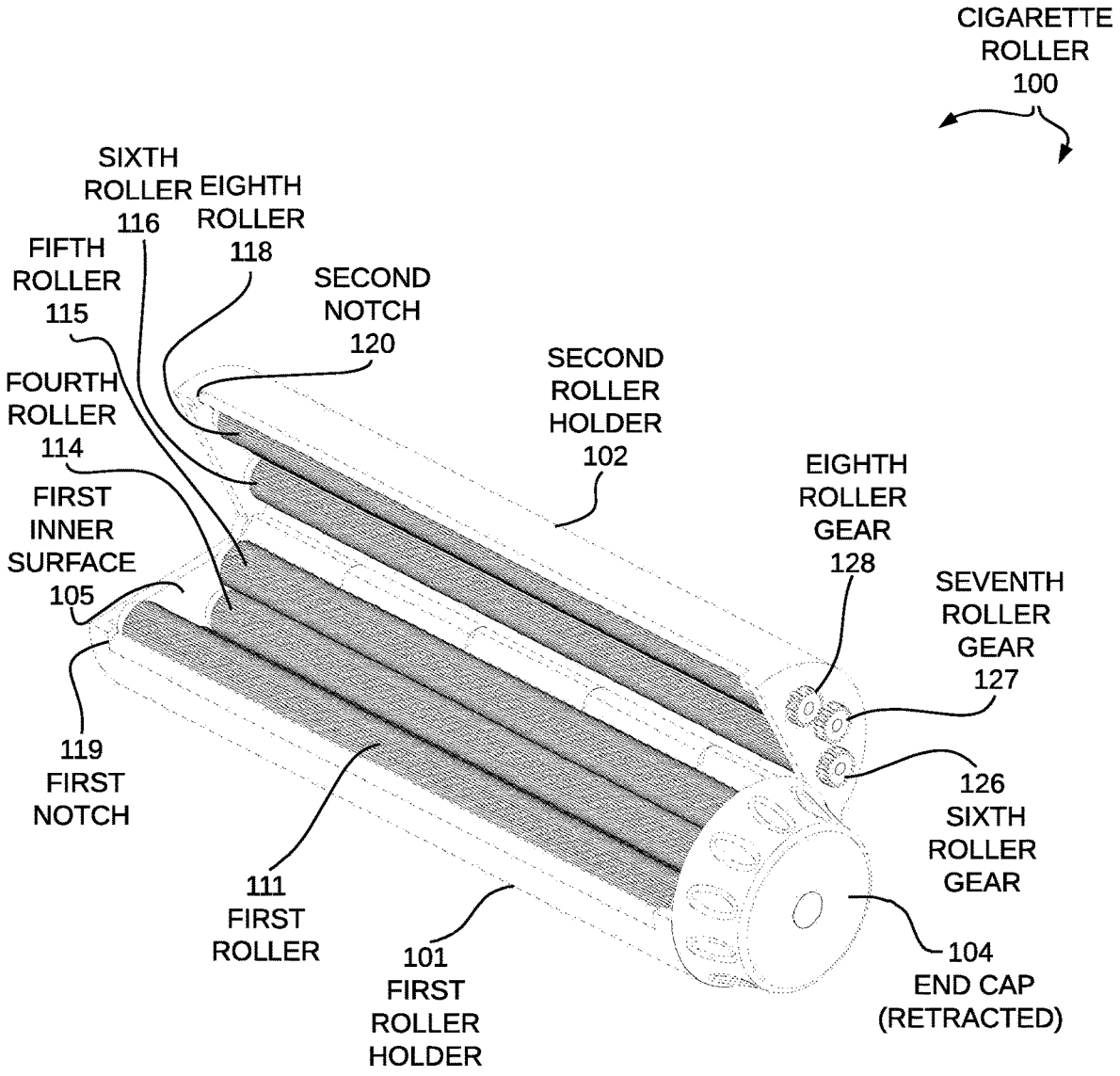
FIG. 2 is a diagram showing a perspective view of cigarette roller 100.

FIG. 2 is a diagram of a perspective view of a cigarette roller 100 in an open position with end cap 104 retracted. Roller gears 126-128 protrude from the first end of the second roller holder 102. End cap 104 at least partially encloses roller gears 121-125. Rollers 111, 114, and 115 are visible within the first roller holder 101. Rollers 116 and 118 are visible within second roller holder 102.

Figure 3:
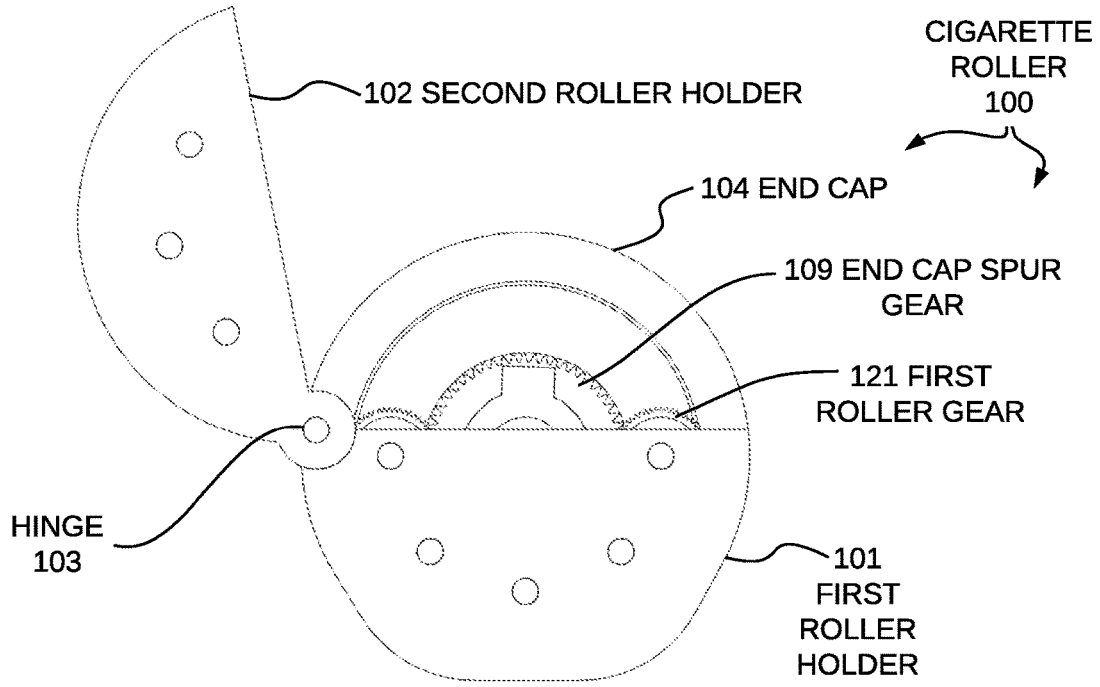
FIG. 3 is a diagram showing an end view of cigarette roller 100 in the open position.

FIG. 3 is a diagram of a side view of cigarette holder 100 in the open position. FIG. 3 shows the second end of first roller holder 101 and the second end of the second roller 102. At the far end of cigarette roller 100, end cap 104, end cap spur gear 109, roller gear 121, and roller gear 125 are also shown. Hinge 103 is also shown. The axles of rollers 111-115 are shown extending at least partially through the second end of the first roller holder 101. The axles of rollers 116-118 are shown extending at least partially through the second end of the second roller holder 102. In another embodiment, axles of rollers 111-115 do not extend through the second end of first roller holder 101, and axles of rollers 116-118 do not extend through the second end of second roller holder 102.

Figure 4:
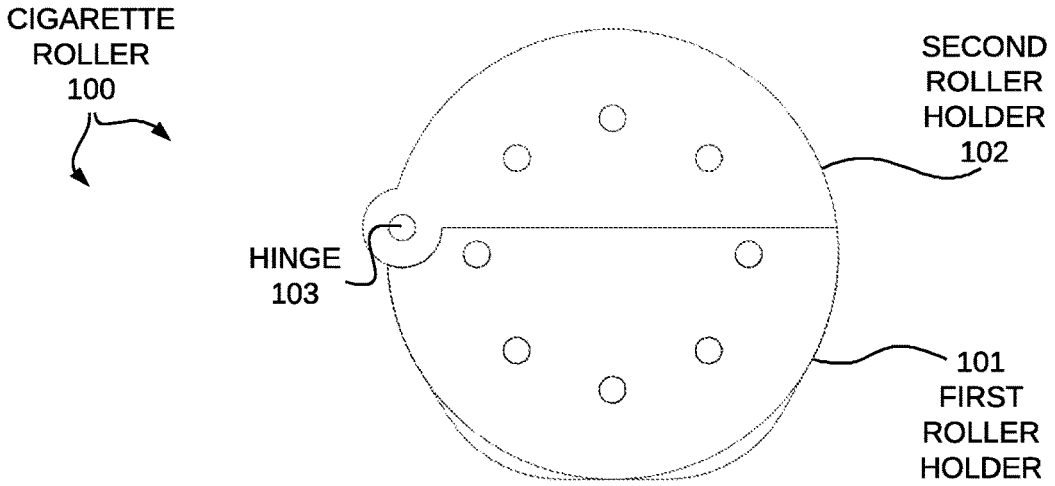
FIG. 4 is a diagram showing an end view of cigarette roller 100 in the closed position.

FIG. 4 is a diagram of a side view of cigarette holder 100 in the closed position. FIG. 4 shows the second end of first roller holder 101 and the second end of the second roller 102. The axles of rollers 111-115 are shown extending at least partially through the second end of the first roller holder 101. The axles of rollers 116-118 are shown extending at least partially through the second end of the second roller holder 102. In another embodiment, axles of rollers 111-115 do not extend through the second end of first roller holder 101, and axles of rollers 116-118 do not extend through the second end of second roller holder 102.

Figure 5:
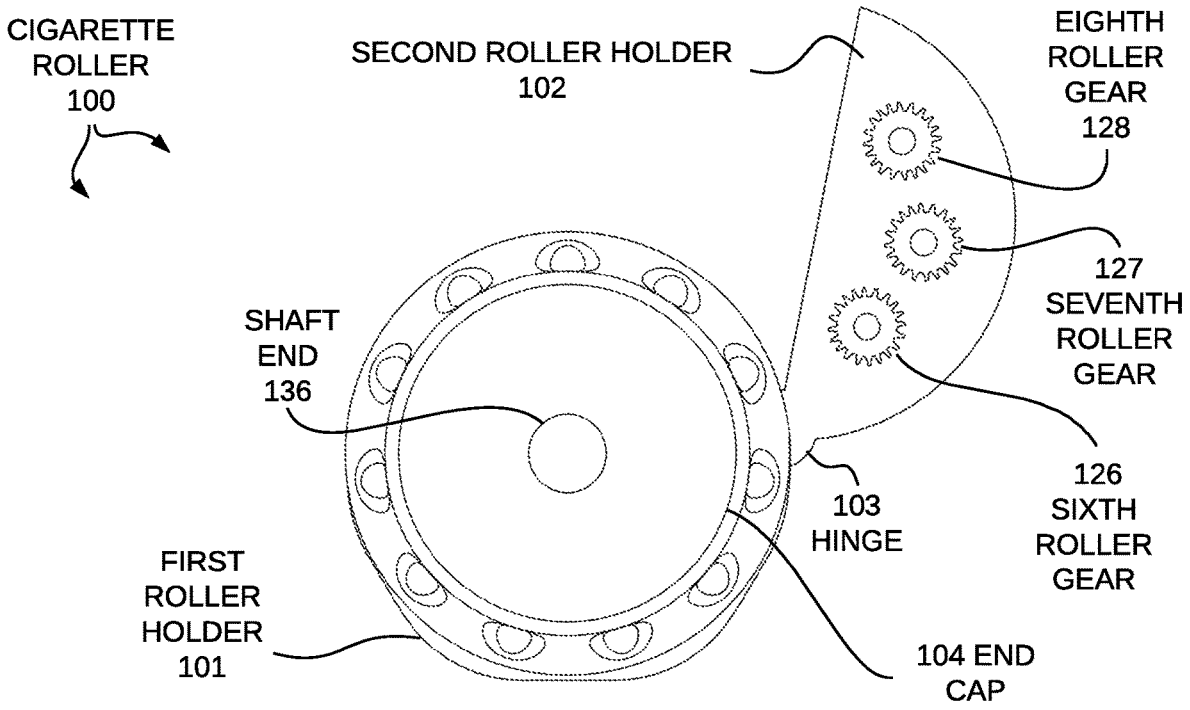
FIG. 5 is a diagram showing an end view of cigarette roller 100 in the open position.

FIG. 5 is a diagram of a side view of cigarette holder 100 in the open position. FIG. 5 shows the first end of the second roller 102 and the end cap 104. Roller gears 126-128 protrude from the first end of second roller holder 102.

Figure 6:
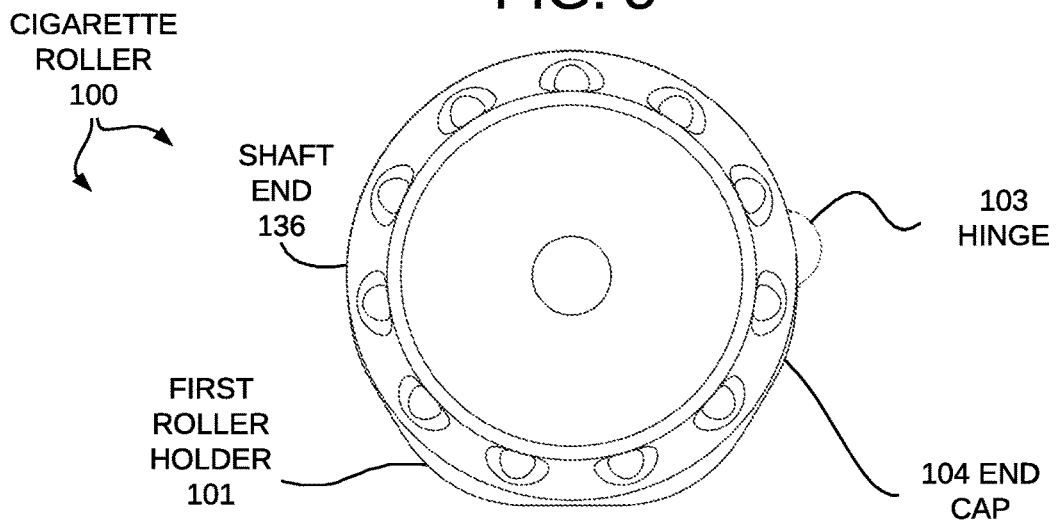
FIG. 6 is a diagram showing an end view of cigarette roller 100 in the closed position.

FIG. 6 is a diagram of a side view of cigarette holder 100 in the closed position. FIG. 6 shows the end cap 104. Shaft end 136 is shown in the center of end cap 104. Hinge 103 is partially shown.

Figure 7:
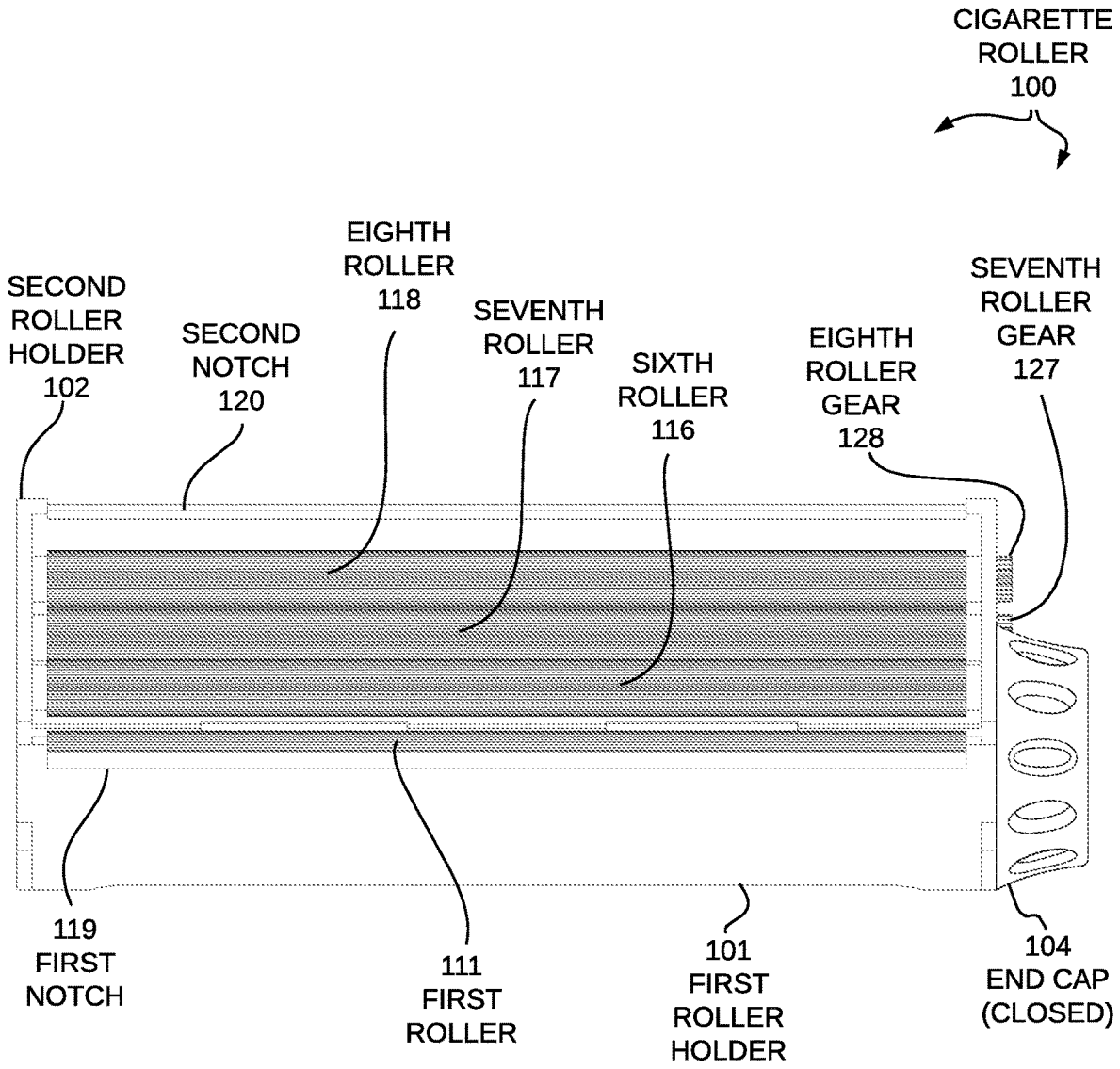
FIG. 7 is a diagram showing a side view of cigarette roller 100 in the open position.

FIG. 7 is a diagram of a side view of cigarette roller 100 in an open position with end cap 104 retracted. Rollers 116-118 are visible within second roller holder 102. End cap 104 is in the retracted position. Roller gears 127 and 128 are visible protruding from the first end of second roller holder 102. A portion of first roller 111 is visible in first roller holder 101.

When end cap 104 is retracted, roller gears 126-128 will interfere with end cap 104 when cigarette roller 100 transitions from the open position to the closed position or vice versa. For example, FIG. 7 shows roller gear 128 extending beyond the edge of end cap 104. If cigarette roller 100 were closed, roller gear 128 would come into contact with end cap 104, and the cigarette roller 100 would not close. In order to transition the cigarette roller 100 from the open position to the closed position, end cap 104 must be in the extended position. End cap 104 is spring-loaded to be in the retracted position when no other force is applied.

Figure 8:
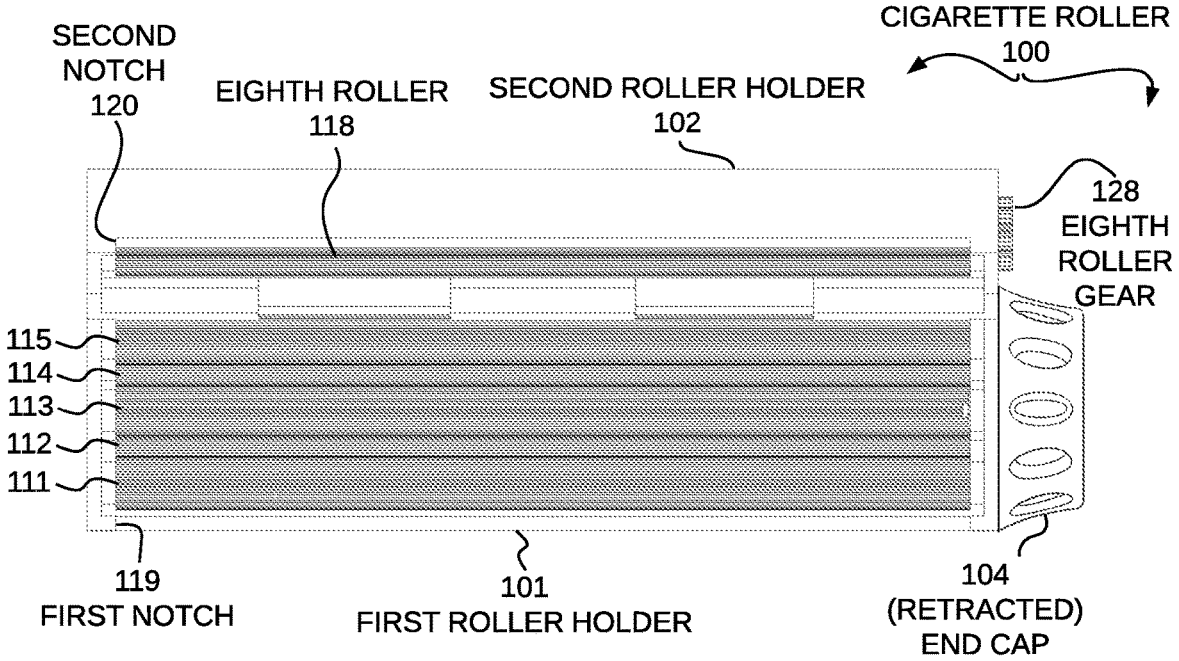
FIG. 8 is a diagram showing a top view of cigarette roller 100 in the open position.

FIG. 8 is a diagram of a top view of cigarette roller 100 in an open position with end cap 104 retracted. FIG. 8 shows roller gear 128 extending beyond the edge of end cap 104, similarly to FIG. 7. Roller 118 is visible in the second roller holder 102. Rollers 111-115 are visible in the first roller holder 101.

Figure 9:
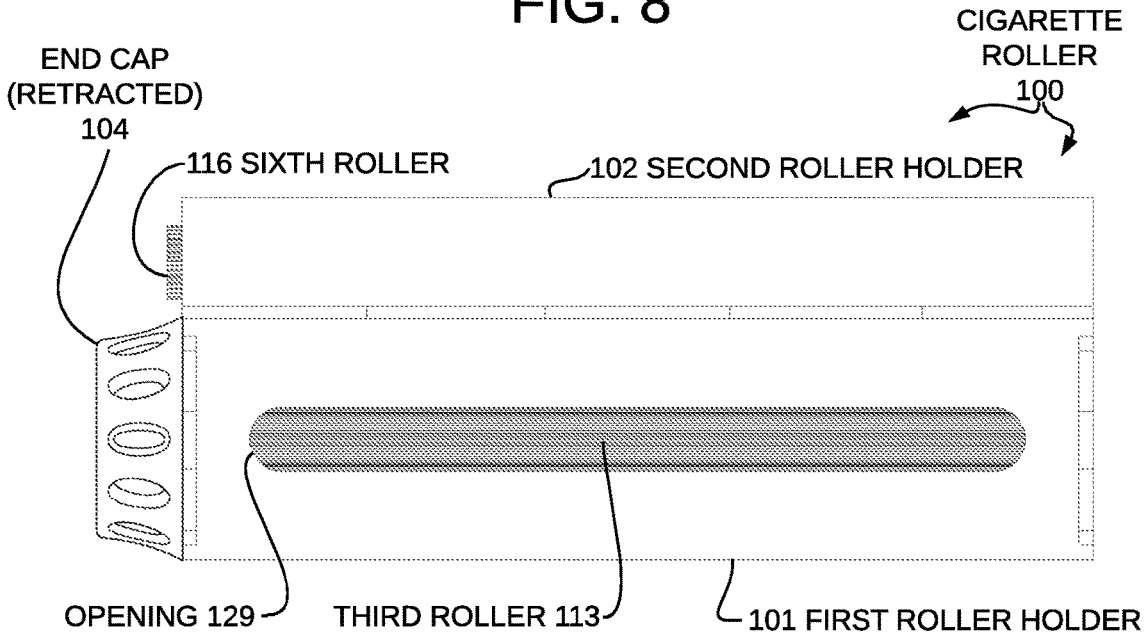
FIG. 9 is a diagram showing a bottom view of cigarette roller 100 in the open position.

FIG. 9 is a diagram of a bottom view of cigarette roller 100 in an open position with end cap 104 retracted. Opening 129 extends between the first inner surface 105 of the first roller holder 101 and the first outer surface 106 of the first roller holder. Opening 129 creates a passage leading from the interior of the cigarette roller 100 to the exterior of cigarette roller 100. The third roller 113 is visible through opening 129. The opening 129 allows smoking material 130 that is not wrapped to escape through opening 129. Although rollers 111-115 and rollers 116-118 are arranged to reduce the amount of smoking material lost, some smoking material may enter the space between a roller and inner surface 105, the space between a roller and inner surface 107, or the space between any two adjacent rollers. Allowing smoking material 130 to escape through opening 129 reduces the buildup of unwrapped smoking material 130 in the spaces between a roller and inner surface 105, between a roller and inner surface 107, or between adjacent rollers. If unwrapped smoking material 130 accumulates within cigarette roller 100, smoking material 130 may become trapped between any two adjacent rollers, between a roller and the inner surface 105, or between a roller and the inner surface 107. If a sufficient amount of smoking material 130 becomes trapped between any two adjacent rollers, between a roller and the inner surface 105, or between a roller and the inner surface 107, at least one roller may be unable to rotate. If at least one roller is unable to rotate, the cigarette roller 100 will not function properly.

Figure 10:
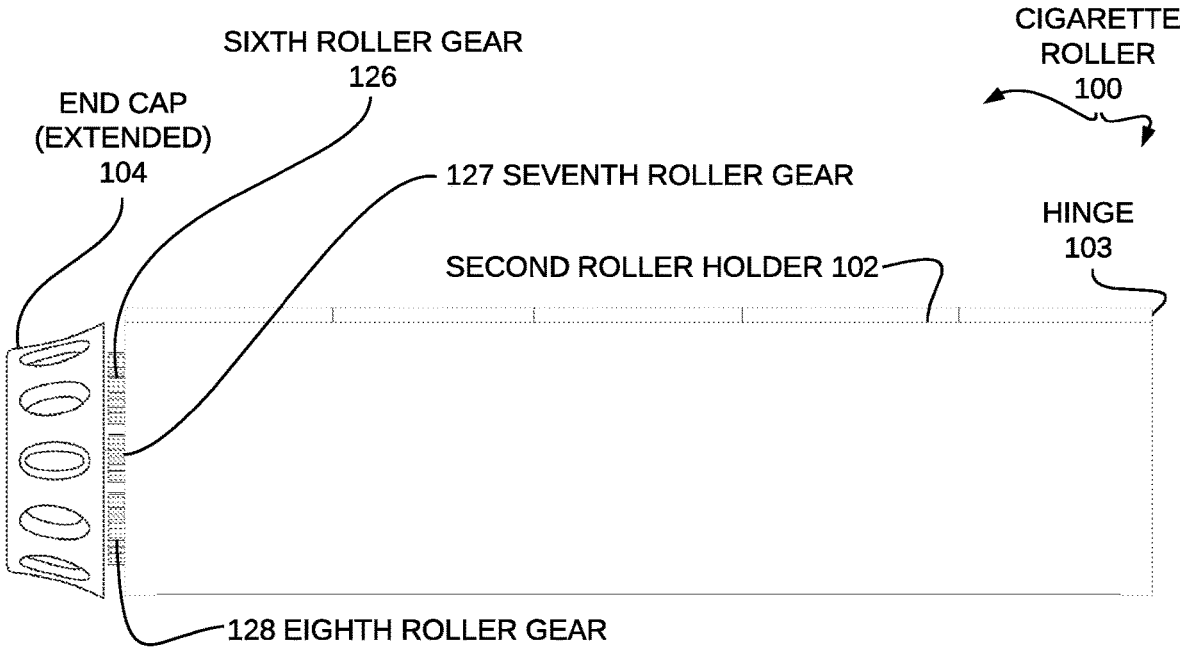
FIG. 10 is a diagram showing a top view of cigarette roller 100 in the closed position.

FIG. 10 is a diagram of a top view of cigarette roller 100 in a closed position with end cap 104 extended. Second roller holder 102, hinge 103, end cap 104 are shown. Roller gears 126-128 can be seen in the gap between the end cap 104 and second roller holder 102.

When end cap 104 is extended, roller gears 126-128 will not interfere with end cap 104 if the cigarette roller 100 is transitioned from the open position to the closed position or vice versa. For example, FIG. 10 shows roller gears 126-128 positioned between the end cap 104 and the second roller holder 102. If cigarette roller 100 is opened, roller gears 126-128 do not come into contact with end cap 104, and the cigarette roller 100 transitions to the open position. In order to transition the cigarette roller 100 from the open position to the closed position, end cap 104 must be extended.

In the extended position, end cap 104 does not enclose roller gears 121-128 and end cap spur gear 109 does not engage roller gears 121-128. In the embodiment shown in FIG. 10, a spring is compressed and pushes against end cap 104 and shaft end 136. The force of the spring holds the end cap in the retracted position. A user or other outside force must hold end cap 104 in the extended position shown in FIG. 10 against the force of the spring.

Figure 11:
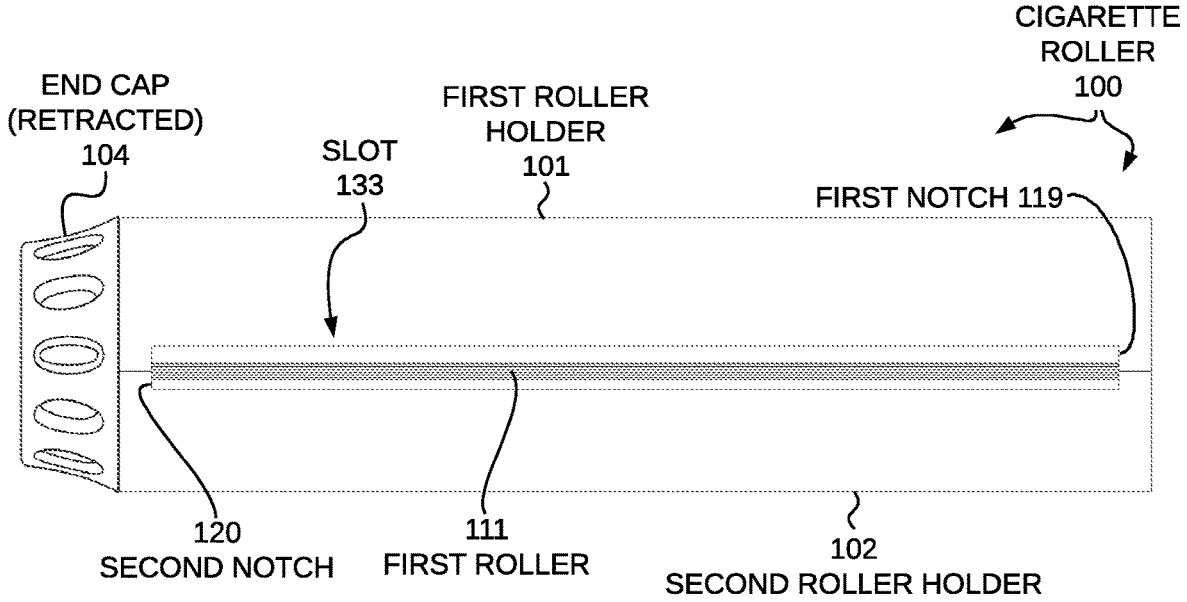
FIG. 11 is a diagram showing a front view of cigarette roller 100 in the closed position.

FIG. 11 is a diagram of a front view of cigarette roller 100 in a closed position with end cap 104 retracted. Slot 133 is created when first notch 119 in first roller holder 101 and second notch 120 in second roller holder 102 meet when cigarette roller 100 is in the closed position. First roller 111 is visible through slot 133. Slot 133 allows wrapping material 131 to pass from the exterior of cigarette roller 100 to the interior of cigarette roller 100 when cigarette roller 100 is in the closed position and in operation. End cap 104 encloses roller gears 121-128 and end cap spur gear 109 engages roller gears 121-128. In the embodiment shown in FIG. 11, a spring is expanded and pushes against end cap 104 and shaft end 136. The force of the spring holds the end cap 104 in the retracted position, against the first end of first roller holder 101.

In one embodiment of cigarette roller 100, a spring is in a compressed state when end cap 104 is in the extended state. In the extended state, end cap 104 does not enclose roller gears 111-118. End cap 104 is free to rotate in the extended state. In another embodiment, end cap 104 includes a locking mechanism. The locking mechanism allows end cap 104 to be held in the extended position against the force of the compressed spring. This allows a user to open and close the cigarette roller 100 without holding the end cap 104 in the extended position. A user engages the lock by pulling the end cap 104 away from the first roller holder 101 in the direction of axis 110, past the extended position, into a locked position. The user disengages the lock by pushing the end cap towards the first roller holder 101 until the force of the spring takes over and forces the end cap 104 into the retracted position. The retracted position is shown in FIG. 11. In another embodiment, the lock is engaged by pulling and twisting the end cap 104. In yet another embodiment, the lock is engaged by operating a lever or latch.

In another embodiment of cigarette roller 100, a spring is in a compressed state when end cap 104 is in the retracted state. When end cap 104 is in the extended state, the spring is in an expanded state, and a user is not required to hold the end cap 104 in the extended state. In the extended state, end cap 104 does not enclose roller gears 111-118. End cap 104 is free to rotate. In one embodiment, end cap 104 includes a locking mechanism. The locking mechanism allows end cap 104 to be held in the retracted state against the force of the compressed spring. When end cap 104 is locked in the retracted state and cigarette roller 100 is in the closed position, cigarette roller 100 will not transition to the open position. When end cap 104 is in the retracted position, end cap spur gear 109 engages at least one of the roller gears 121-128. As the end cap 104 is rotated in a first direction, rollers 111-118 rotate in a second direction opposite the first direction. A user engages the lock by pushing the end cap 104 toward the first roller holder 101 in the direction of axis 110, into a locked position. The user disengages the lock by pulling the end cap 104 away from the first roller holder 101 until the force of the spring takes over and forces the end cap 104 into the extended position. In another embodiment, the lock is engaged by pushing and twisting the end cap 104. In yet another embodiment, the lock is engaged by operating a lever or latch.

Figure 12:
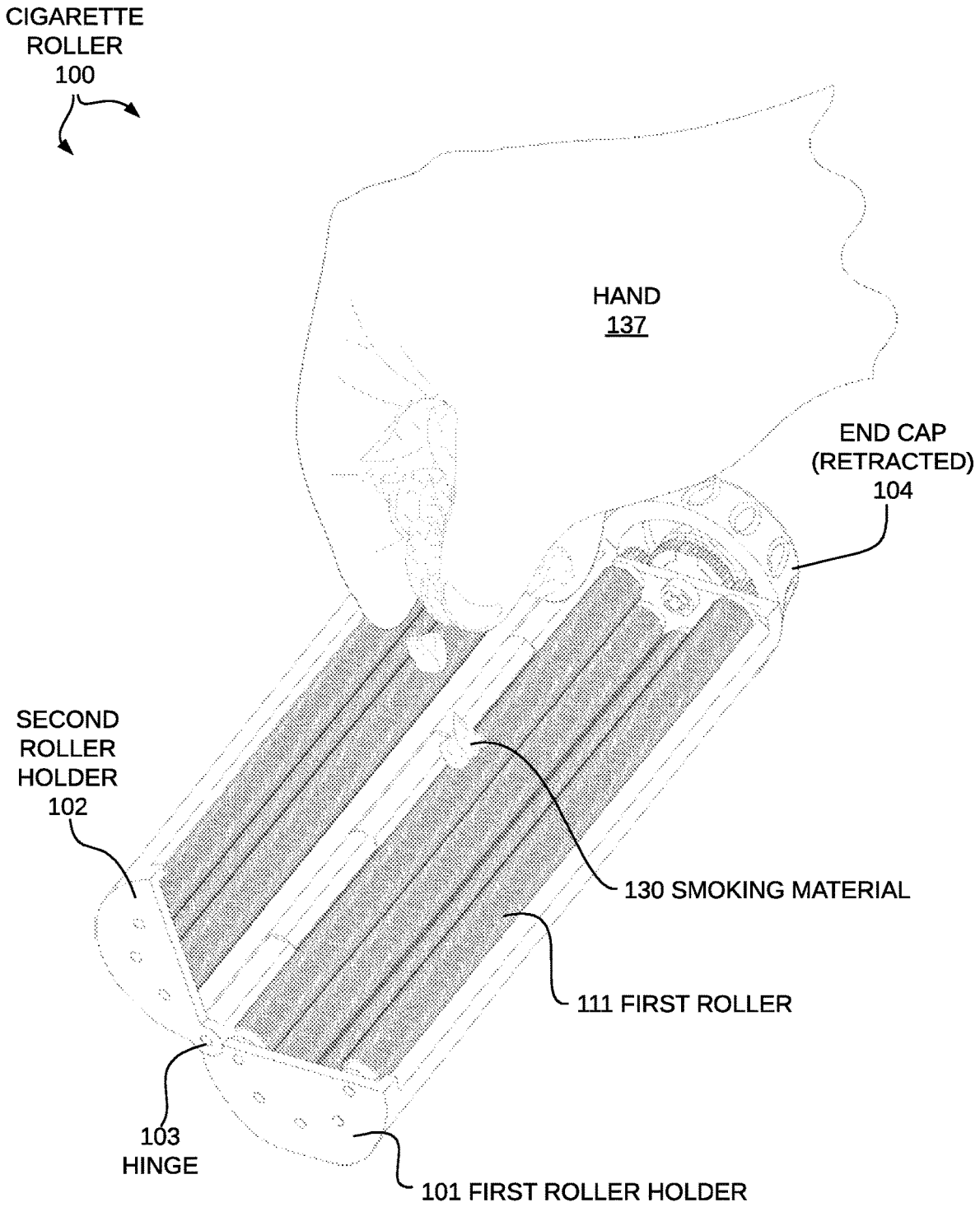
FIGS. 12-18 are a series of diagrams showing steps of rolling a cigarette using cigarette roller 100.

FIG. 12 is a diagram of a perspective view of a cigarette roller 100 in use. Cigarette roller 100 is in the open position. In rolling step A, cigarette roller 100 is in the open position with the end cap 104 retracted. A user places smoking material 130 within the first roller holder 101.

Figure 13:
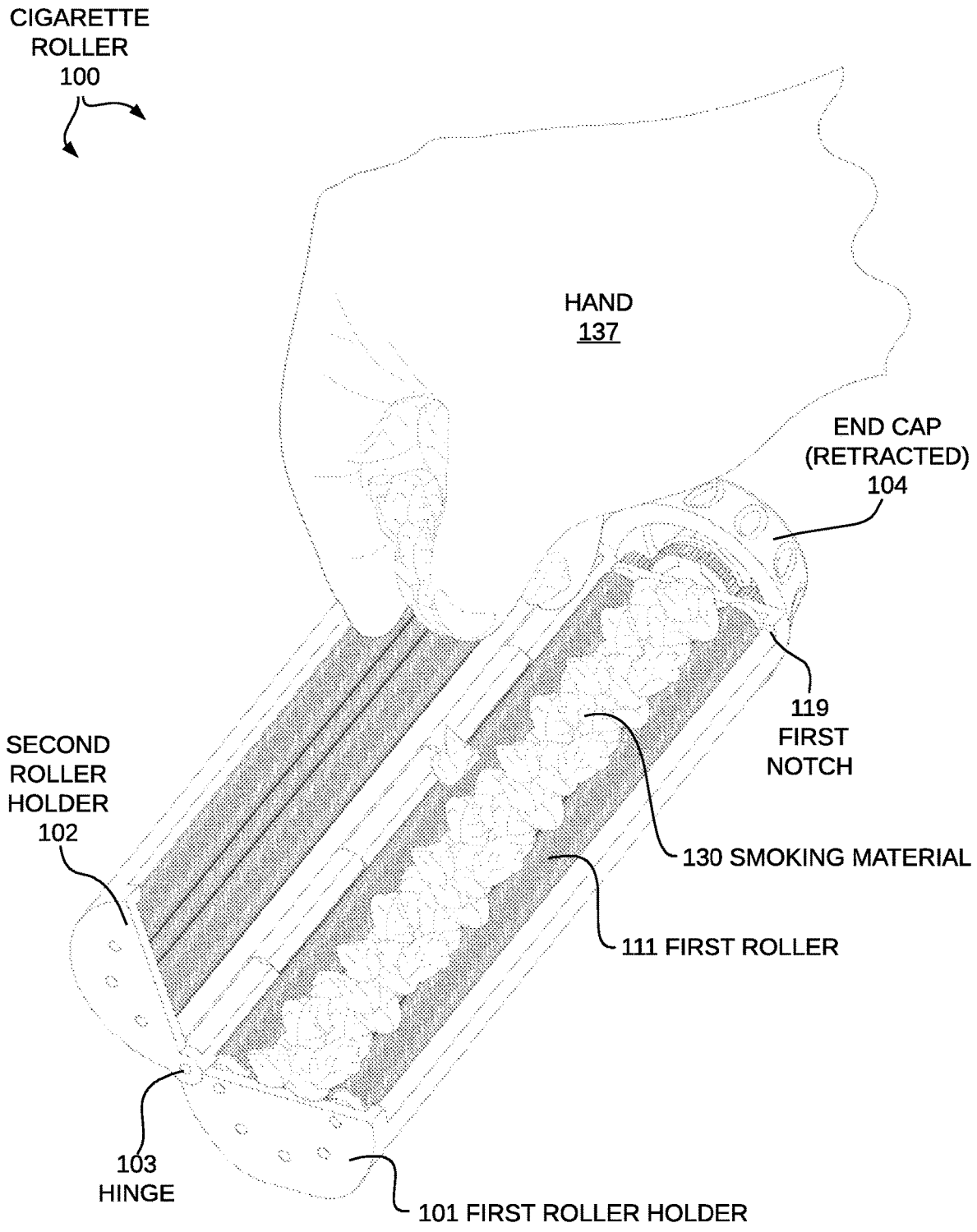

FIG. 13 is a diagram of a perspective view of a cigarette roller 100 in use. Cigarette roller 100 is in the open position. In rolling step B, the first roller holder 101 is filled with the user's desired amount of smoking material 130. The user will then extend end cap 104 and close the cigarette roller 100.

Figure 14:
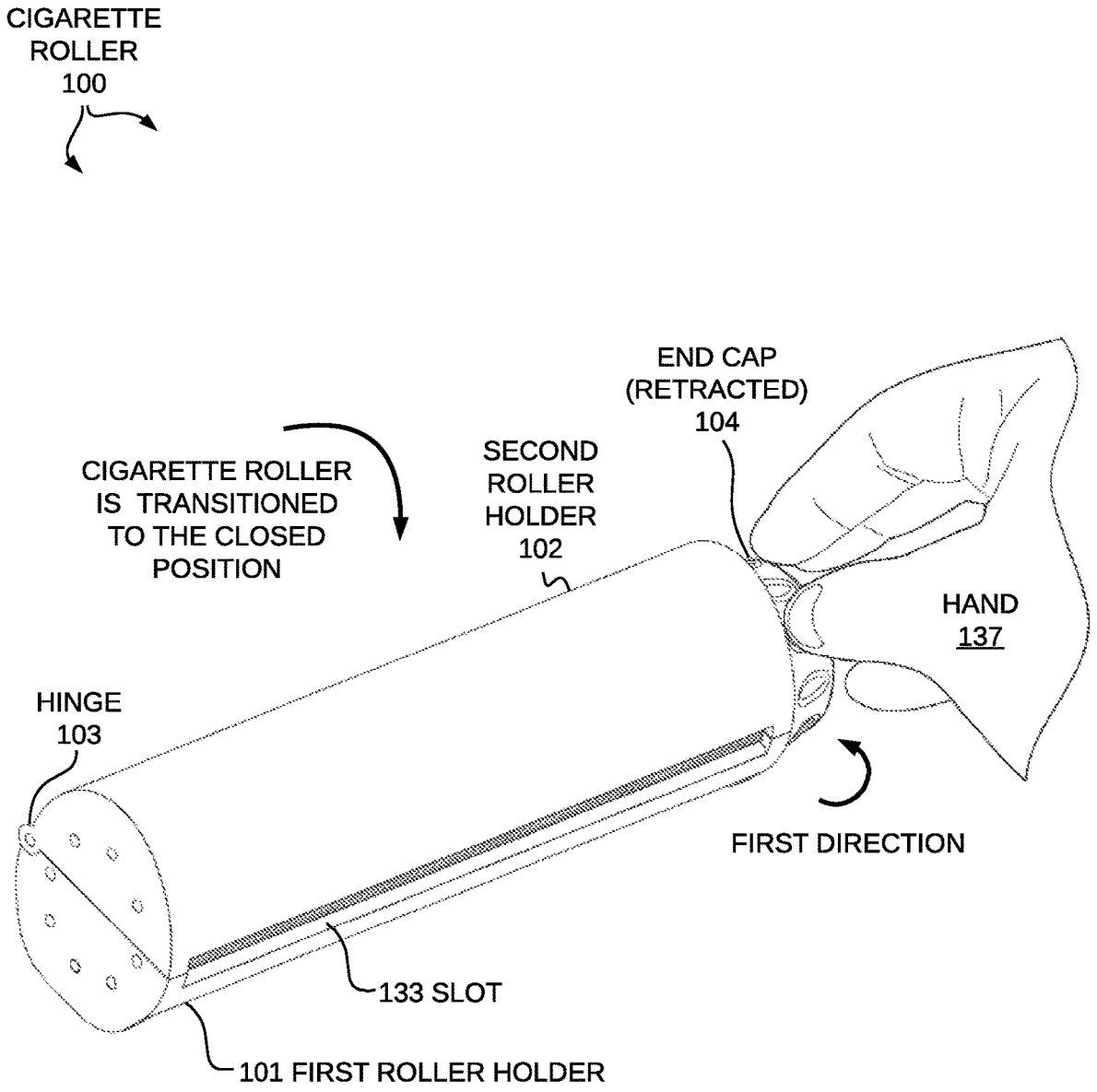

FIG. 14 is a diagram of a perspective view of cigarette roller 100 in use. Cigarette roller 100 is in the closed position. In rolling step C, The user rotates end cap 104 in a first direction which causes end cap spur gear 109 to rotate in the first direction. In this embodiment, the user rotates end cap 104 with hand 137. In another embodiment, a user uses another means to rotate end cap 104. End cap spur gear 109 engages roller gears 121-128 and roller gears 121-128 rotate in a second direction opposite the first direction. The user rotates the end cap 104 a number of full or partial rotations based on their preference or based on the requirements of the smoking material 130 used. A user may choose to rotate the end cap 104 in the first direction and then rotate the end cap 104 in the second direction, opposite the first direction. Generally, the user seeks to form the smoking material 130 into a cylindrical shape. In one embodiment, the user rotates the end cap 104 at least one full rotation in a first direction and continues to rotate in a first direction until the desired shape of smoking material 130 is obtained. In another embodiment, the user rotates the end cap 104 one partial rotation in a first direction, and then a partial rotation in a second direction opposite the first direction, and continues to rotate or alternate rotation directions until the desired shape of smoking material 130 is obtained. The user may rotate the end cap 104 in any pattern of first or second directions and any number or full or partial rotations to achieve the desired shape of smoking material 130. After rotating the end cap 104 sufficiently, the user opens cigarette roller 100.

Figure 15:
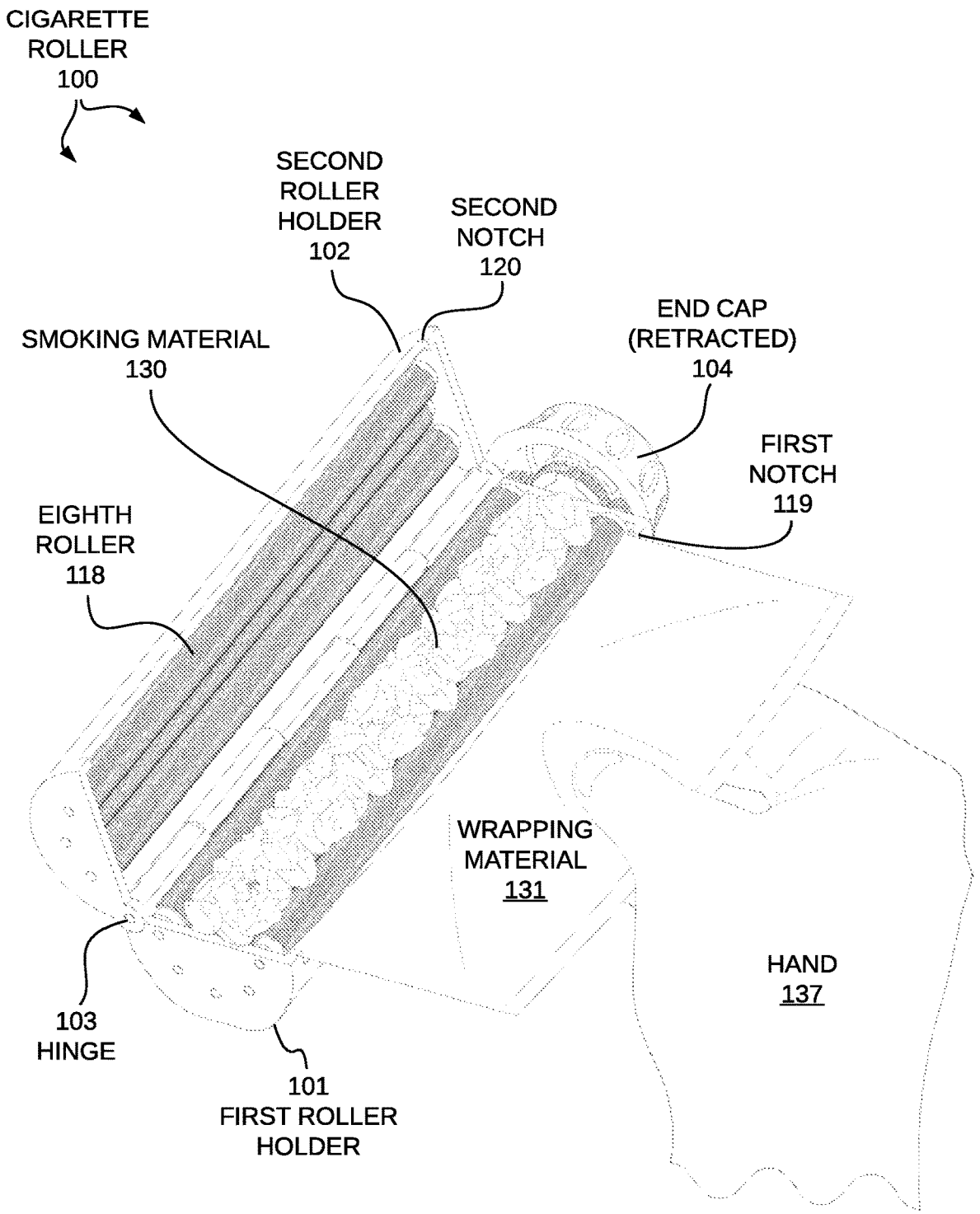

FIG. 15 is a diagram of a perspective view of a cigarette roller 100 in use. Cigarette roller 100 is in the open position. In rolling step D, smoking material 130 is in a cylindrical shape. The user places wrapping material 131 so that it is in contact with roller 111, and extends through the first notch 119. The user then closes the cigarette roller 100.

Figure 16:
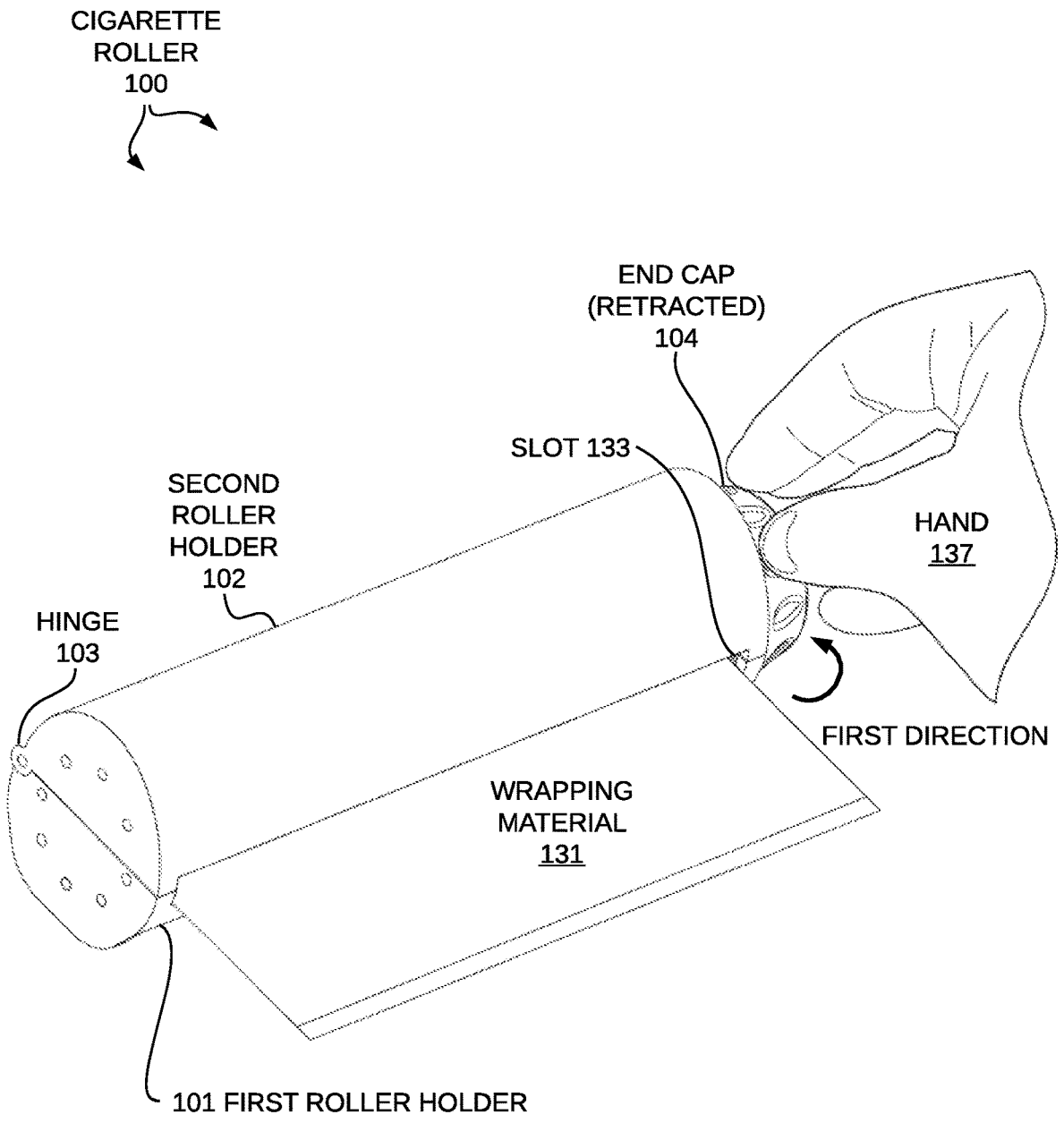

FIG. 16 is a diagram of a perspective view of a cigarette roller 100 in use. Cigarette roller 100 is in the closed position. Once the user has closed cigarette roller 100, the second notch 120 meets the first notch 119 and forms slot 133. Wrapping material 131 is now in contact with roller 111 and extends out of cigarette roller 100 through slot 133. In rolling step E, the user rotates the end cap 104. When end cap 104 rotates, rollers 111-118 rotate. The wrapping material 131 is in contact with at least one of the rollers 111-118. The wrapping material 131 is drawn into the roller through slot 133 and between the smoking material 130 and the rollers 111-118.

Figure 17:
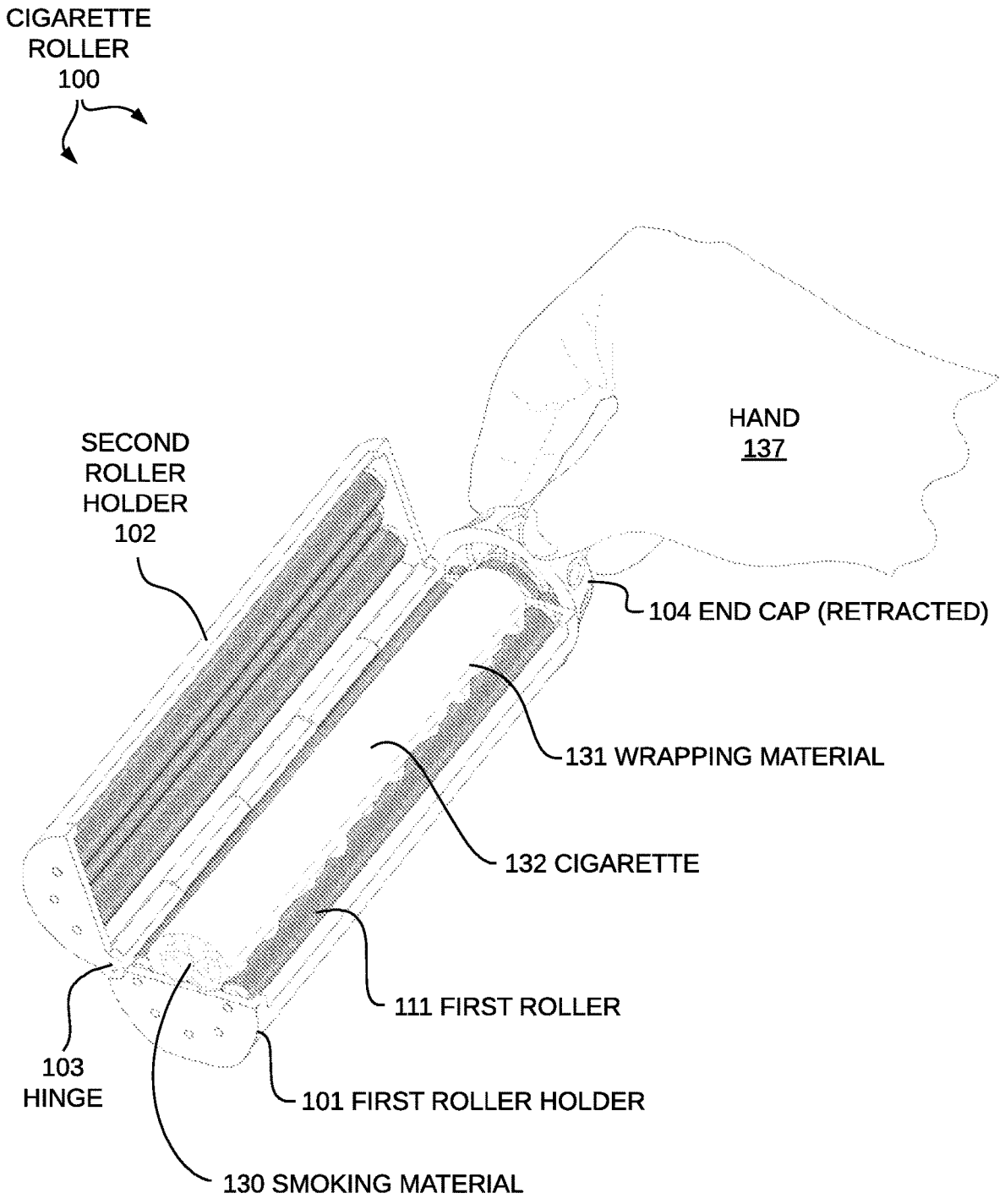

FIG. 17 is a diagram of a perspective view of cigarette roller 100 in use. Cigarette roller 100 is in the open position. In rolling step F, the wrapping material 131 surrounds the smoking material 130, forming a cigarette 132.

Figure 18:
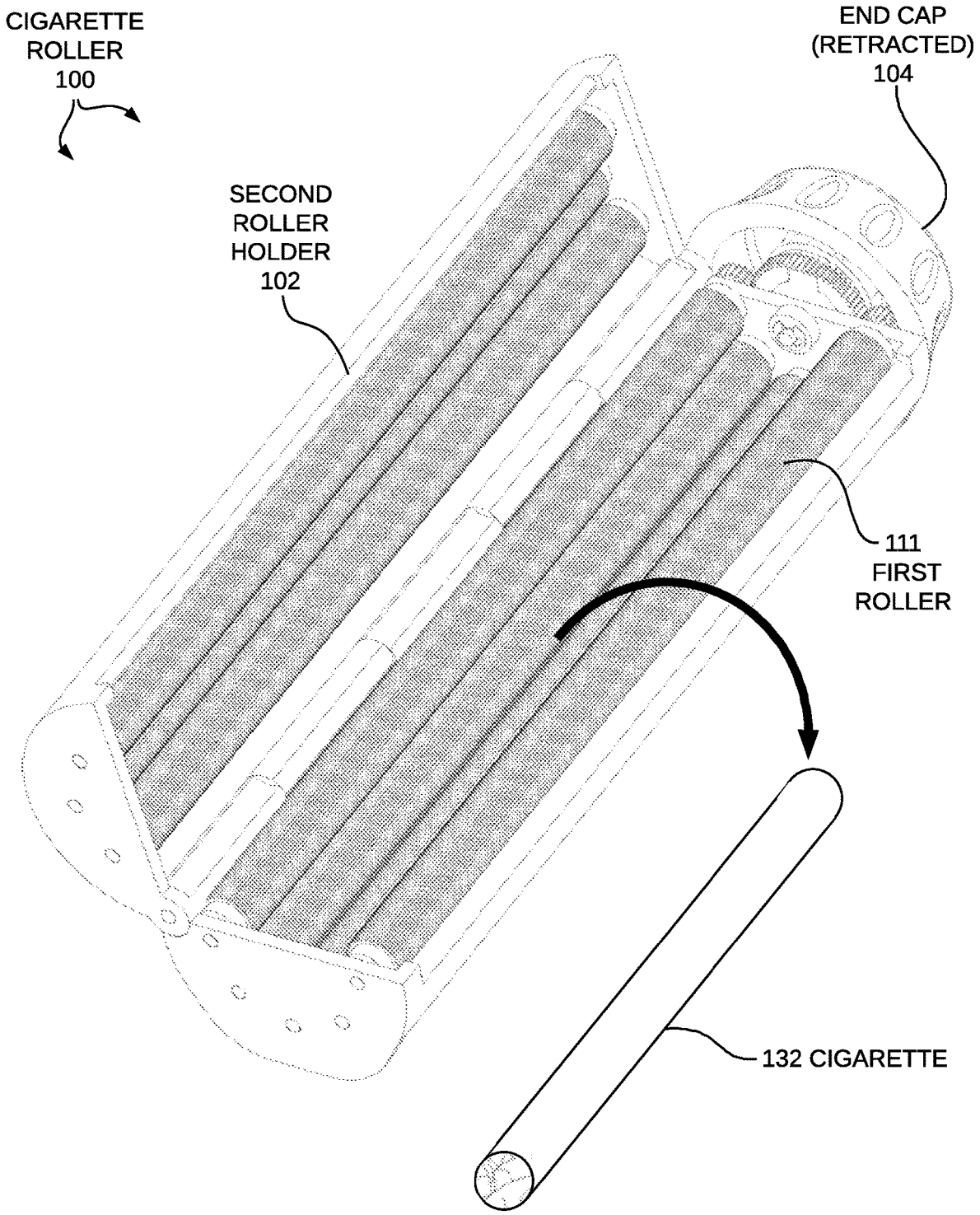

FIG. 18 is a diagram of a perspective view of cigarette roller 100 in the open position, and cigarette 132. In rolling step G, when the user has finished forming the cigarette 132, cigarette 132 is removed from cigarette roller 100.

Figure 19:
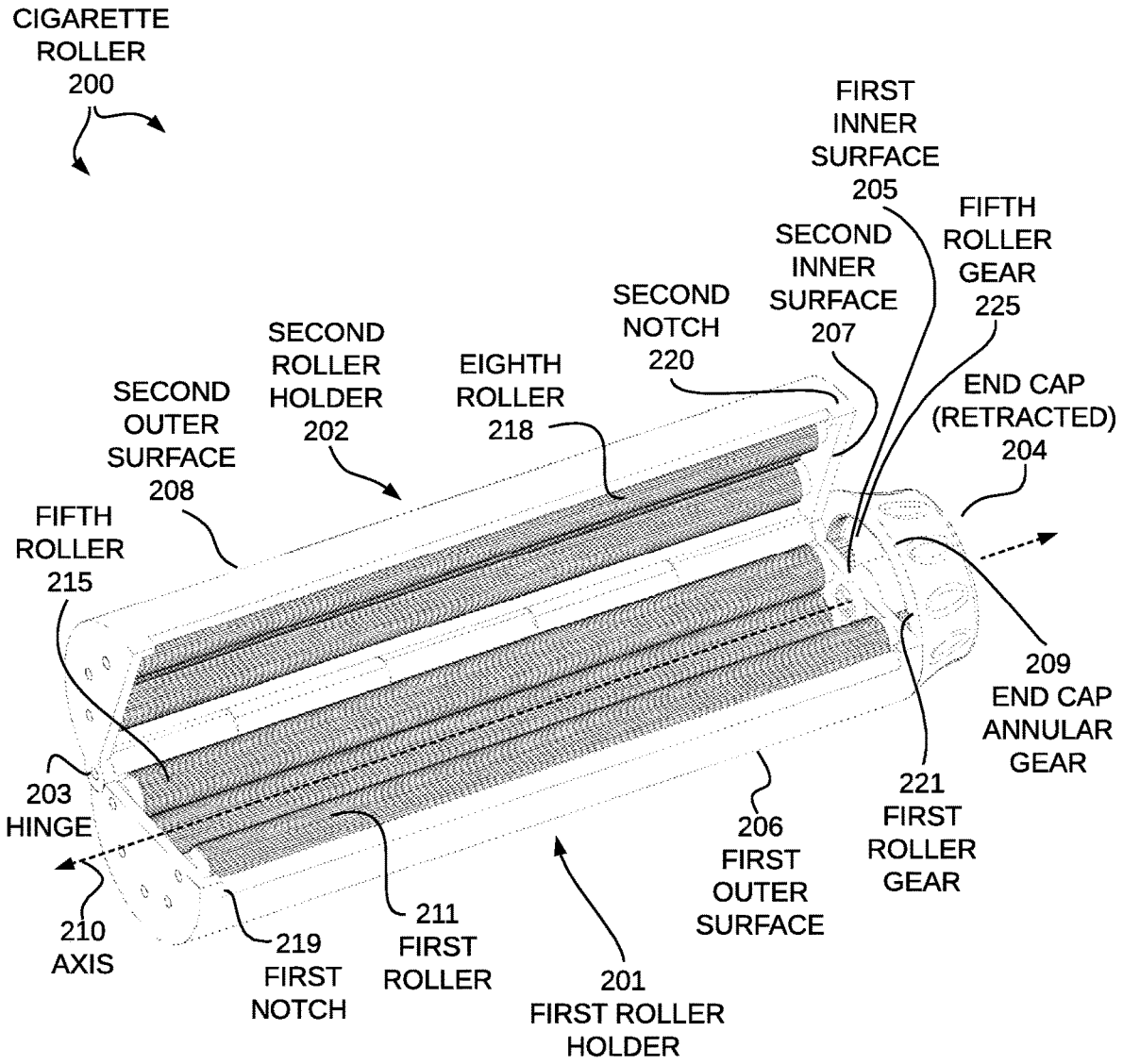
FIG. 19 is a diagram showing a perspective view of cigarette roller 200.
Figure 20:
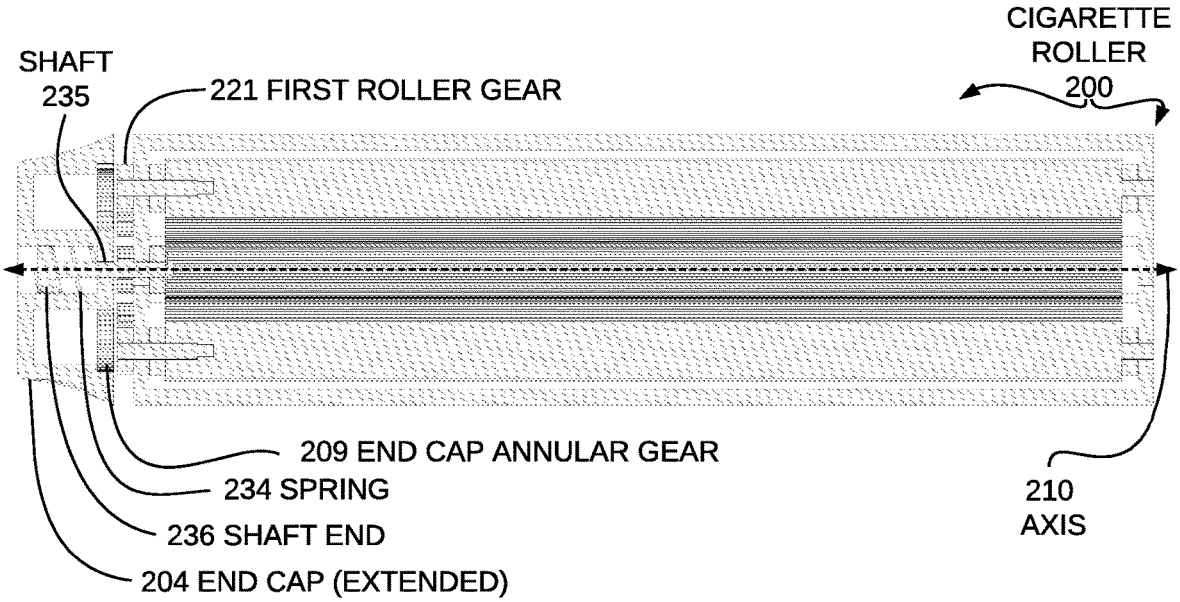
FIG. 20 is a diagram showing a cross-section view of cigarette roller 200.
Figure 21:
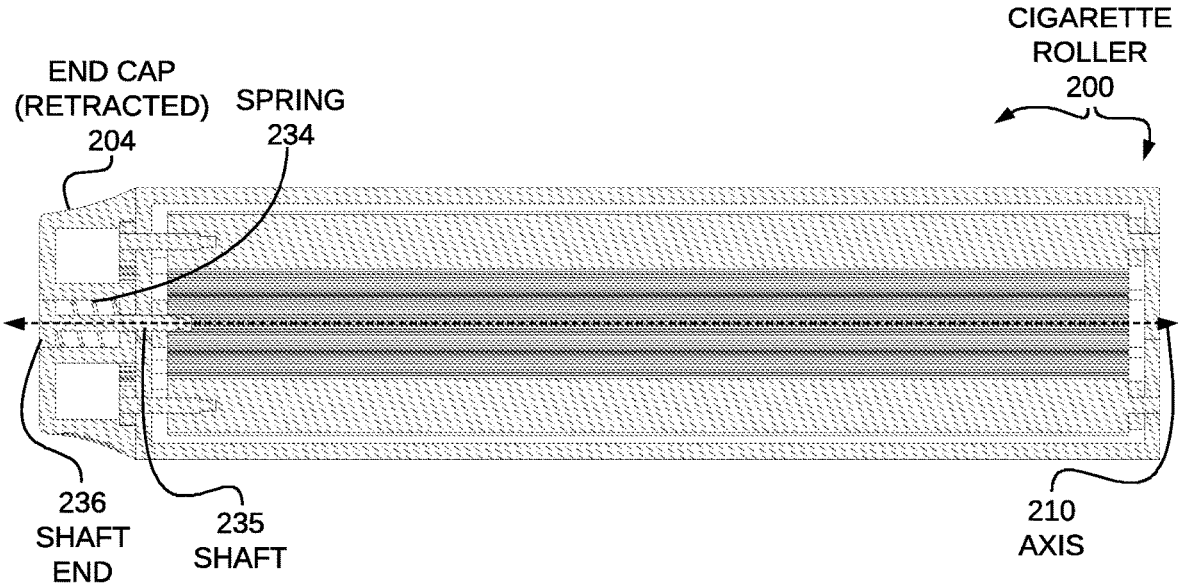
FIG. 21 is a diagram showing a cross-section view of cigarette roller 200.

The end cap 104 of cigarette roller 100 shown in FIGS. 1-18 has retracted and extended positions that are structurally and functionally similar to cigarette roller 200 as shown in FIGS. 19-21.

FIG. 19 is a diagram of a perspective view of cigarette roller 200. The cigarette roller 200 comprises a first roller holder 201, a second roller holder 202, a hinge 203, an end cap 204, a first plurality of rollers 211-215, and a second plurality of rollers 216-218.

The first roller holder 201 comprises a hollow body with a first inner surface 205, a first outer surface 206, and rollers 211-215. The first roller holder 201 has a first end, and a second end opposite the first end. The first roller holder 201 includes a first notch 219. First notch 219 is opposite hinge 203. First notch 219 extends along at least the majority of the length between the first end and second end of the first roller holder 201. The depth of first notch 219 is less than or equal to the radius of a roller.

The first plurality of rollers 211-215 comprises five rollers. Rollers 211-215 are cylinders wherein the length (or height) of the cylinder is greater than the diameter of the cylinder. Each roller has an axis that extends through the center of a first circular cross section of the roller and through the center of a second circular cross section of the roller. Each roller rotates about the axis of the roller. Rollers 211-215 extend from the first end of first roller holder 201 to the second end of first roller holder 201. Rollers 211-215 are arranged within the hollow space of the first roller holder 201 parallel to one another. Rollers 211-215 are placed such that the distance between the inner surface 205 of first roller holder 201 and the outer surface of any of the rollers 211-215 is less than the diameter of a roller. The rollers 211-215 are arranged such that the distance between the outer surfaces of any two adjacent rollers 211-215 is less than the diameter of a roller. The spacing between the inner surface 205 of the first roller holder 201 and any of the rollers 211-215 allows the cigarette roller 200 to remain as compact as possible. The adjacent spacing between each of the rollers 211-215 reduces the amount of smoking material 230 entering the space between any two adjacent rollers 211-215. Roller gears 221-225 protrude from the outer surface of the first end of the first roller holder 201. Roller gears 221-225 are circular spur gears. Roller gears 221-225 are coaxial with the axis of the roller to which the gear is attached.

The second roller holder 202 comprises a hollow body with a second inner surface 207, a second outer surface 208, and rollers 216-218. The second roller holder 202 has a first end, and a second end opposite the first end. The second roller holder 202 includes a second notch 220. Second notch 220 is opposite hinge 203. Second notch 220 extends along at least the majority of the length between the first end and second end of the second roller holder 202. The depth of second notch 220 is less than or equal to the radius of a roller.

The second plurality of rollers 216-218 comprises three rollers. Rollers 216-218 are cylinders wherein the length (or height) of the cylinder is greater than the diameter of the cylinder. Each roller has an axis that extends through the center of a first circular cross section of the roller and through the center of a second circular cross section of the roller. Each roller rotates about the axis of the roller. Rollers 216-218 extend from the first end of second roller holder 202 to the second end of second roller holder 202. Rollers 216-218 are arranged within the hollow space of the second roller holder 202 parallel to one another. Rollers 216-218 are placed such that the distance between the inner surface 207 of second roller holder 202 and the outer surface of any of the rollers 216-218 is less than the diameter of a roller. The rollers 216-218 are arranged such that the distance between the outer surfaces of any two adjacent rollers 216-218 is less than the diameter of a roller. The spacing between the inner surface 207 of the second roller holder 202 and any roller 216-218 allows the cigarette roller 200 to remain as compact as possible. The spacing between each of the rollers 216-218 reduces the amount of smoking material 230 that enters the space between any two adjacent rollers 216-218. Roller gears 226-228 protrude from the outer surface of the first end of the second roller holder 202. Roller gears 226-228 are circular spur gears. Roller gears 226-228 are coaxial with the axis of the roller to which the gear is attached.

In the embodiment shown in FIG. 19, there are two pluralities of rollers: a first plurality of rollers 211-215, and a second plurality of rollers 216-218. When combined, the two pluralities amount to a total of eight rollers 211-218. In one embodiment, each of the rollers 211-218 has an outer surface made of a non-slip material. In another embodiment, each of the rollers 211-218 has an outer surface with ridges arranged parallel to the axis of the roller. In yet another embodiment, each of the rollers 211-218 has an outer surface with a pattern of ridges and/or valleys. Roller gear 221 is attached to the first end of roller 211. Roller gear 222 is attached to the first end of roller 212. Roller gear 223 is attached to the first end of roller 213. Roller gear 224 is attached to the first end of roller 214. Roller gear 225 is attached to the first end of roller 215. Roller gear 226 is attached to the first end of roller 216. Roller gear 227 is attached to the first end of roller 217. Roller gear 228 is attached to the first end of roller 218. The second end of each roller 211-218 is an axle. For clarity, rollers may be referred to as "first roller 211, second roller 212 . . . eighth roller 218" in some cases. For clarity, roller gears may be referred to as "first roller gear 221, second roller gear 222 . . . eighth roller gear 228" in some cases. In another embodiment, there are one, two, three, four, five, six, seven, nine, ten, eleven, or twelve rollers. In yet another embodiment, the number of rollers is a multiple of two, a multiple of three, a multiple of five, a multiple of seven, a prime number, or a multiple of a prime number.

The first roller holder 201 and the second roller holder 202 are attached via hinge 203. The first end of the first roller holder 201 is in plane with the first end of the second roller holder 202. In one embodiment, the first roller holder 201 and the second roller holder 202 are permanently attached via the hinge 203. In another embodiment, roller holder 201 and roller holder 202 are detachable at the hinge 203.

Figure 22:
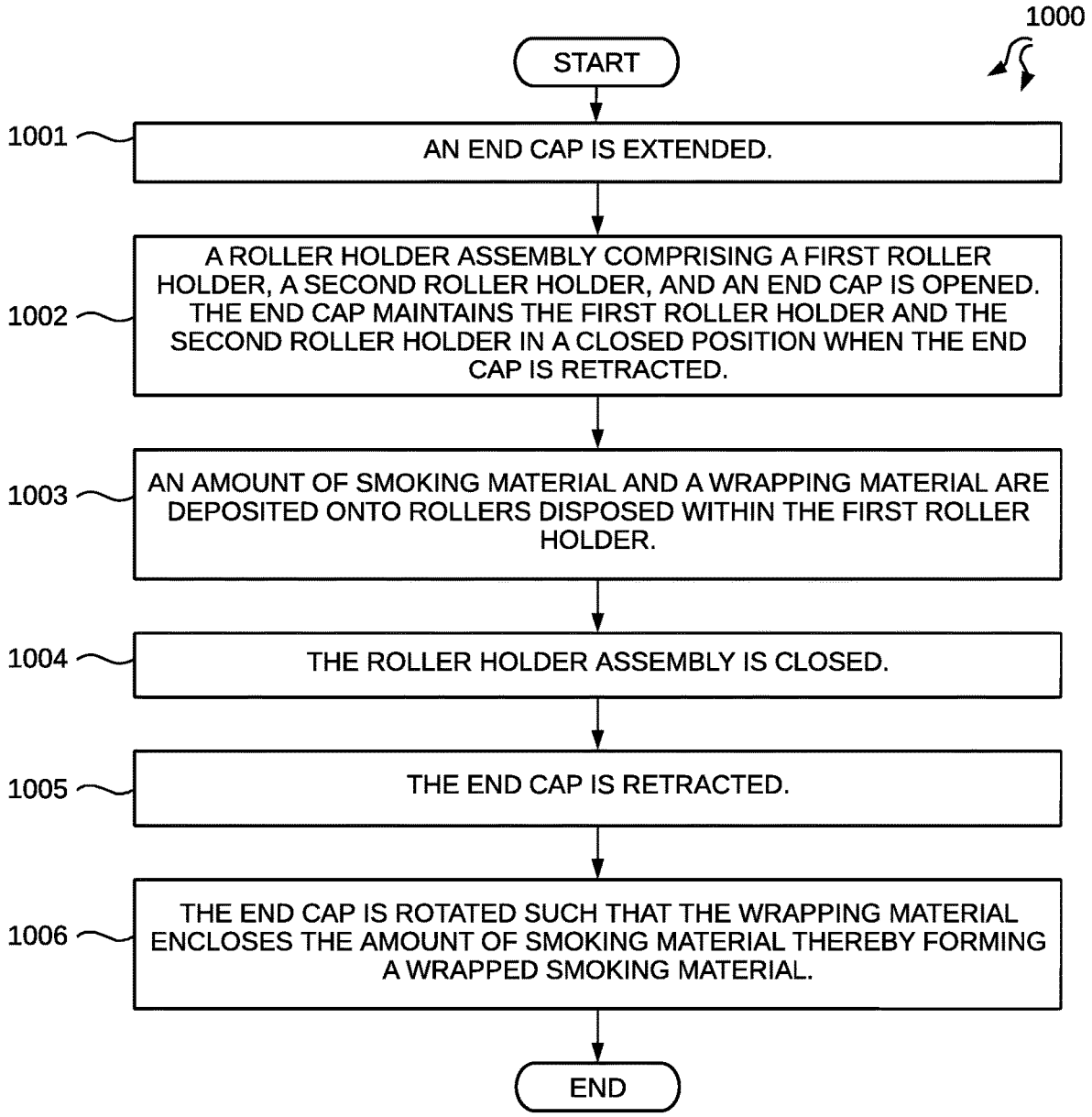
FIG. 22 is a flow chart of a method 1000.

End cap 204 is connected to the first end of the first roller holder 201 via shaft 235 (see FIG. 22). End cap 204 has an axis 210 through the center. End cap annular gear 209 is attached to end cap 204 and is coaxial with axis 210. End cap annular gear 209 is a ring gear with gear teeth disposed on the inner circumference of the gear. In one embodiment, the gear teeth of annular gear 209 are integrated into the inner circumference of the end cap 209. In another embodiment, annular gear 209 is a ring gear attached to end cap 204 and the annular gear 209 will rotate when end cap 204 is rotated. End cap 204 is positionable in an extended position or a retracted position.

The cigarette roller 200 is positionable in an open or closed position. End cap 204 is positionable in an extended position or a retracted position. When cigarette roller 200 is in the closed position, the hollow portion of the first roller holder 201 and the hollow portion of the second roller holder 202 are adjacent. In the closed position, first notch 219 and second notch 220 are adjacent and form slot 233. When the cigarette roller 200 is in the open position, the hollow portion of the first roller holder 201 and the hollow portion of the second roller holder 202 are not adjacent. When the cigarette roller 200 is in the open position and end cap 204 is in the retracted position, end cap annular gear 209 engages roller gears 221-225. The roller gears 221-225 do not engage with one another. When the cigarette roller 200 is in the closed position and end cap 204 is in the retracted position, end cap annular gear 209 engages roller gears 221-228. The roller gears 221-228 do not engage with one another.

When end cap 204 is in the extended position, end cap 204 is disposed a distance away from but still connected to the first end of the first roller holder 201 via shaft 235 (see FIG. 22). The distance between end cap 204 and first roller holder 201 is greater than the thickness of any of the roller gears 221-228. When the cigarette roller 200 is in the open position and end cap 204 is in the retracted position, end cap 204 at least partially encloses roller gears 221-225. When the cigarette roller 200 is in the closed position and the end cap 204 is in the retracted position, end cap 204 at least partially encloses roller gears 221-228. When cigarette roller 200 is in the open position, end cap 204 is in the retracted position, and end cap 204 rotates in a first direction, end cap annular gear 209 engages roller gears 221-225 and rollers 211-215 rotate in a second direction opposite the first direction. When cigarette roller 200 is in the closed position, end cap 204 is in the retracted position, and end cap 204 rotates in the first direction, end cap annular gear 209 engages roller gears 221-228 and rollers 211-218 rotate in the second direction.

FIG. 20 is a diagram of a cross-sectional view of cigarette roller 200 with end cap 204 extended. End cap 204 does not enclose roller gears 221-228 and end cap annular gear 209 does not engage roller gears 221-228. In this embodiment, spring 234 is compressed and pushing against end cap 204 and shaft end 236. The force of the spring 234 holds the end cap in the retracted position. A user or other outside force must hold end cap 204 in the extended position shown in FIG. 22 against the force of the spring 234.

FIG. 21 is a diagram of a cross-sectional view of cigarette roller 200 with end cap 204 retracted. End cap 204 encloses roller gears 221-228 and end cap annular gear 209 engages roller gears 221-228. In this embodiment, spring 234 is expanded and pushing against end cap 204 and shaft end 236. The force of the spring 234 holds the end cap in the retracted position, against the first end of first roller holder 201.

Figure 23:
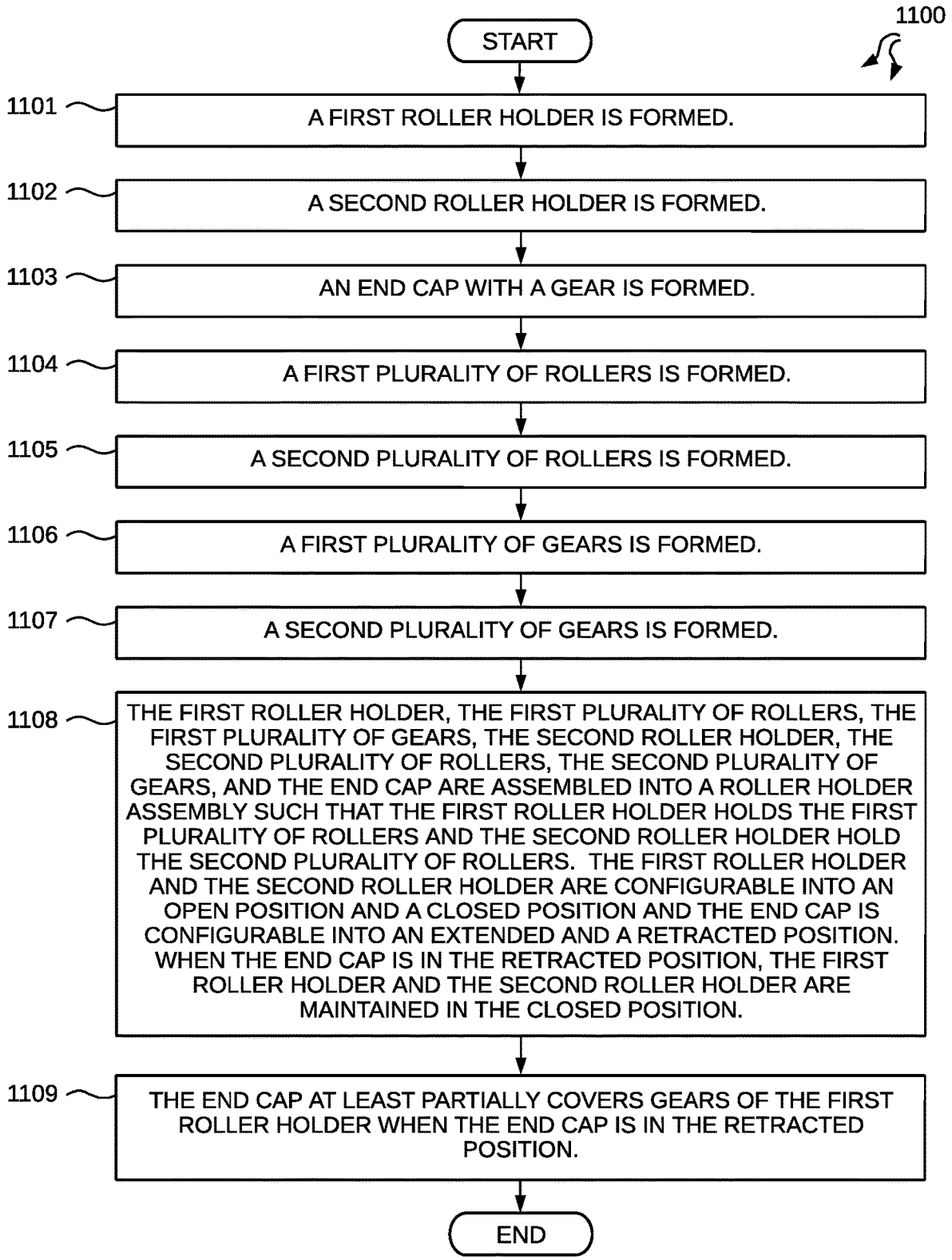
FIG. 23 is a flow chart of a method 1100.

In one embodiment of cigarette roller 200, spring 234 is in a compressed state when end cap 204 is in the extended state. In the extended state, end cap 204 does not enclose roller gears 211-218. End cap 204 is free to rotate, but when end cap 204 is in the extended state, end cap annular gear 209 is not engaged with any roller gear 221-228, and therefore rollers 211-218 will not rotate when end cap 204 is rotated. In one embodiment, end cap 204 includes a locking mechanism. The locking mechanism allows end cap 204 to be held in the extended state against the force of the compressed spring. This allows a user to freely open and close the cigarette roller 200 without holding the end cap 204 in the extended position. A user engages the lock by pulling the end cap 204 away from the first roller holder 201 in the direction of axis 210, past the extended position, into a locked position. The user disengages the lock by pushing the end cap towards the first roller holder 201 until the force of the spring takes over and forces the end cap 204 into the retracted position. The retracted position is shown in FIG. 23. In another embodiment, the lock is engaged by pulling and twisting the end cap 204. In yet another embodiment, the lock is engaged by operating a lever or latch.

In another embodiment of cigarette roller 200, spring 234 is in a compressed state when end cap 204 is in the retracted state. When end cap 204 is in the extended state, spring 234 is in an expanded state and a user is not required to hold the end cap 204 in the extended state. In the extended state, end cap 204 does not enclose roller gears 211-218. End cap 204 is free to rotate, but when end cap 204 is in the extended state, end cap annular gear 209 is not engaged with any roller gear 221-228, and therefore rollers 211-218 will not rotate when end cap 204 is rotated. In one embodiment, end cap 204 includes a locking mechanism. The locking mechanism allows end cap 204 to be held in the retracted state against the force of the compressed spring. When end cap 204 is locked in the retracted state and cigarette roller 200 is in the closed position, cigarette roller 200 will not transition to the open position. When end cap 209 is in the retracted position, end cap annular gear 209 engages at least one of the roller gears 221-228. As the end cap 204 is rotated in a first direction, rollers 211-218 rotate in a second direction opposite the first direction. A user engages the lock by pushing the end cap 204 toward the first roller holder 201 in the direction of axis 210, into a locked position. The user disengages the lock by pulling the end cap away from the first roller holder 201 until the force of the spring takes over and forces the end cap 204 into the extended position. In another embodiment, the lock is engaged by pushing and twisting the end cap 204. In yet another embodiment, the lock is engaged by operating a lever or latch.

FIG. 22 is a flowchart of a method 1000 in accordance with one novel aspect. In a first step (step 1001), an end cap is extended. For example, in FIG. 10 end cap 104 is in the extended position, and in FIG. 20 end cap 204 is in the extended position. In a second step (step 1002), a roller holder assembly comprising a first roller holder, a second roller holder, and an end cap is opened. The end cap maintains the first roller holder and the second roller holder in a closed position when the end cap is retracted. For example, in FIGS. 1-3 cigarette roller 100 is in the open position. In FIG. 11, end cap 104 is in the retracted position and at least partially encloses roller gears 121-128, thereby preventing cigarette roller 100 from opening. In a third step (step 1003), an amount of smoking material and a wrapping material are deposited onto rollers disposed within the first roller holder. For example, in FIGS. 12 and 13 smoking material 130 is deposited onto rollers 111-115. In a fourth step (step 1004), the roller holder assembly is closed. For example, in FIG. 14 cigarette roller 100 is closed. In a fifth step (step 1005), the end cap is retracted. For example, in FIGS. 14 and 16 end cap 104 is in the retracted position. In a sixth step (step 1006), the end cap is rotated such that the wrapping material encloses the amount of smoking material thereby forming a wrapped smoking material. For example, in FIG. 16 a directional arrow indicates end cap 104 is rotated in a first direction.

FIG. 23 is a flowchart of a method 1100 in accordance with one novel aspect. In a first step (step 1101), a first roller holder is formed. For example, FIG. 1 shows a first roller holder 101. In a second step (step 1102), a second roller holder is formed. For example, FIG. 1 shows a second roller holder 102. In a third step (step 1103), an end cap with a gear is formed. For example, FIG. 1 shows an end cap 104. In a fourth step (step 1104), a first plurality of rollers is formed. For example, FIG. 1 shows a first plurality of rollers 111-115, disposed within the first roller holder 101. In a fifth step (step 1105), a second plurality of rollers is formed. For example, FIG. 1 shows a second plurality of rollers 116-118, disposed within the second roller holder 102. In a sixth step (step 1106), a first plurality of gears is formed. For example, FIG. 1 shows roller gears 121 and 125. In a seventh step (step 1106), a second plurality of gears is formed. For example, FIG. 2 shows rollers 126-128. In an eighth step (step 1108), the first roller holder, the first plurality of rollers, the first plurality of gears, the second roller holder, the second plurality of rollers, the second plurality of gears, and the end cap are assembled into a roller holder assembly such that the first roller holder holds the first plurality of rollers and the second roller holder hold the second plurality of rollers. The first roller holder and the second roller holder are configurable into an open position and a closed position and the end cap is configurable into an extended and a retracted position. When the end cap is in the retracted position, the first roller holder and the second roller holder are maintained in the closed position. For example, FIG. 1 shows an assembled cigarette roller 100 with a first roller holder 101, a first plurality of rollers 111-115 disposed within the first roller holder 101, a first plurality of gears 121-125 (121 and 125 are shown), a second roller holder 102, a second plurality of rollers 116-118 disposed within the second roller holder 102, and an end cap 104 in the retracted position. FIG. 1 also shows hinge 103 which holds first roller holder 101 and second roller 102 together. FIG. 2 shows roller gears 126-128. FIG. 11 shows end cap 104 in the retracted position and at least partially encloses roller gears 121-128, thereby preventing cigarette roller 100 from opening and maintains the cigarette roller 100 in the closed position. In a ninth step (step 1109), the end cap at least partially covers gears of the first roller holder when the end cap is in the retracted position. For example, FIG. 11 shows cigarette roller 100 in the closed position with end cap 104 in the retracted position and no gears are exposed.

Figure 24:
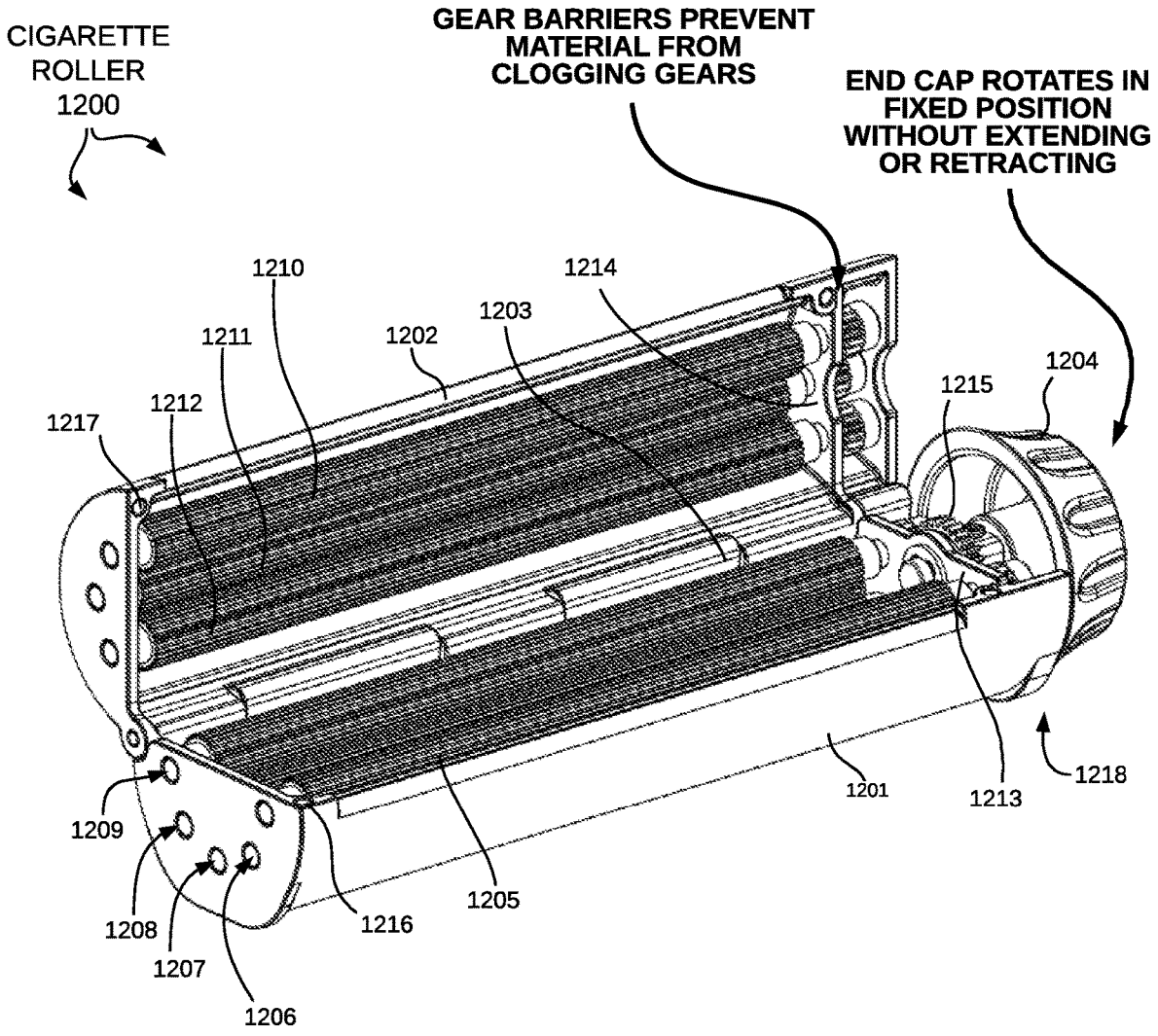
FIG. 24 is a diagram of a perspective view of cigarette roller 1200 in accordance with another embodiment.

FIG. 24 is a diagram of a perspective view of cigarette roller 1200 in accordance with another embodiment. The cigarette roller 1200 has an end cap 1204 that rotates in a fixed position. The end cap 1204 does not extend or retract like the end cap 104 shown in FIG. 1. Providing the end cap 1204 at a fixed position promotes functionality of single-handed operation and reduces manufacturing complexity as compared to embodiments having springs or retracting end caps. In addition, the cigarette roller 1200 includes gear barriers 1213 and 1214 in each roller holder. The gear barriers 1213 and 1214 provide physical separation between the gears and smoking material. The gear barriers 1213 and 1214 reduce the likelihood of gears getting clogged during operation of the cigarette roller 1200.

The cigarette roller 1200 comprises a first roller holder 1201, a second roller holder 1202, a hinge 1203, magnets 1216 and 1217, an end cap 1204, a first plurality of rollers 1205-1209, a second plurality of rollers 1210-1212, gear barriers 1213 and 1214, and a primary gear 1215. The first gear barrier 1213 is provided at an end 1218 of the first roller holder 1201. The second gear barrier 1214 is provided at the end 1218 of the second roller holder 1202. The first gear barrier 1213 separates a non-slip surface of each of rollers 1205-1209 from its respective gear. The second gear barrier 1214 separates a non-slip surface of each of rollers 1210-1212 from its respective gear.

Each roller has a non-slip surface or wrapping material contact surface that is adapted to engage wrapping material, such as rolling paper. In this example, the surface is a non-slip surface formed via a surface with ridges. The end cap 1204 rotates in a fixed position and does not retract or extend. Magnets are used to secure the first roller holder 1201 to the second roller holder 1202 in a closed position. For example, in the closed position, magnet 1216 on the first roller holder 1201 mates with magnet 1217 on the second roller holder 1202.

In accordance with at least one novel aspect, the first gear barrier 1213 and the second gear barrier 1214 have contoured nonlinear contact surfaces that fit together when the cigarette roller 1200 is in the closed configuration. This ensures adequate separation between gears and non-slip surfaces and reduces the likelihood that material will enter the gears during operation of the cigarette roller 1200. The first gear barrier 1213 has a notch that extends upward and that tracks the primary gear 1215. The second gear barrier 1214 has a corresponding dip that extends inwards and mates with the notch of the first gear barrier 1213 when the cigarette roller 1200 is in the closed configuration.

Figure 25:
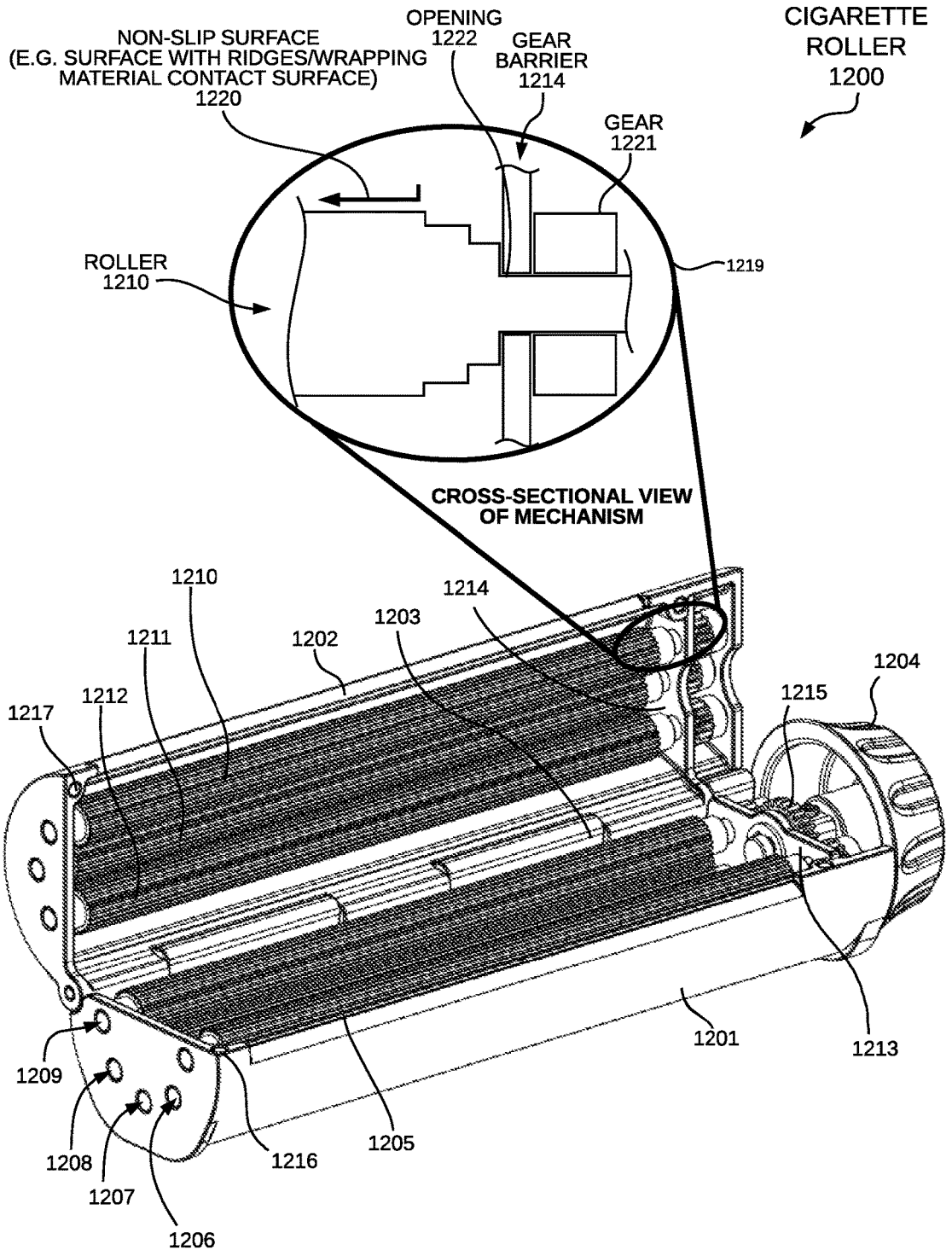
FIG. 25 is a diagram showing a more detailed view of how gear barriers separate gears from non-slip surfaces of the rollers.

FIG. 25 is a diagram showing a more detailed view of how gear barriers separate gears from non-slip surfaces of the rollers. The first gear barrier 1213 and second gear barrier 1214 protect gears at ends of each roller 1205-1212 and the primary gear 1215 from coming into contact with smoking material during operation. The first gear barrier 1213 has five openings for each respective roller 1205-1209. The second gear barrier 1214 has three openings for each respective roller 1210-1212. Each non-slip surface of each roller couples to each respective gear of the roller via an opening in the gear barrier. Reference numeral 1219 identifies an expanded view of a cross-section of roller 1210.

As shown in this expanded cross-sectional view 1219, roller 1210 includes a non-slip surface 1220 and a gear 1221. The non-slip surface 1220 extends from one end of the second roller holder 1202 to an opposite end of the second roller holder 1202. The non-slip surface 1220 and the gear 1221 couple together through an opening 1222 of the second gear barrier 1214. The second gear barrier 1214 separates gear 1221 from the non-slip surface 1220 of the roller 1212 while direct coupling is maintained between the gear 1221 and the non-slip surface 1220. The first gear barrier 1213 operates in a similar fashion to separate gears from non-slip surfaces of the first plurality of rollers 1205-1209.

Figure 26:
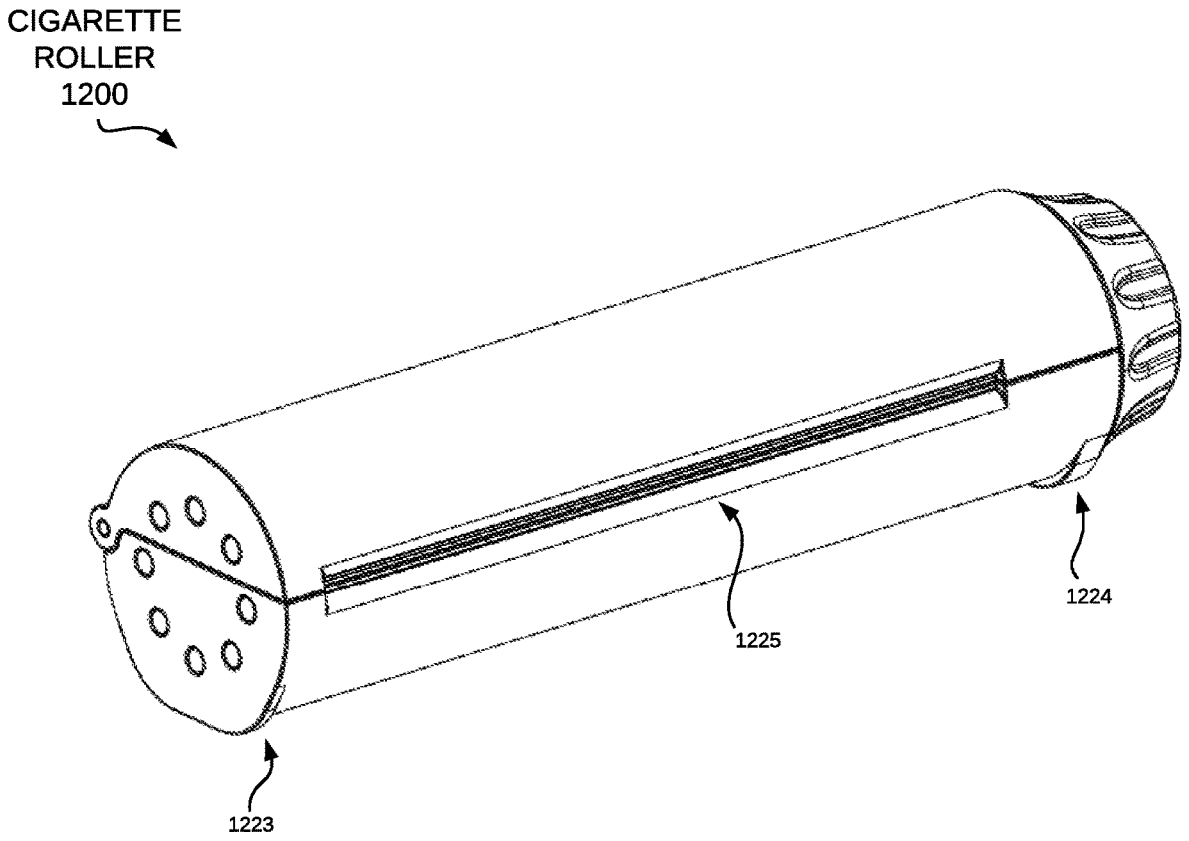
FIG. 26 is a diagram showing a perspective view of the cigarette roller 1200 in a closed configuration.

FIG. 26 is a diagram showing a perspective view of the cigarette roller 1200 in a closed configuration. The cigarette roller 1200 includes optional protrusions 1223 and 1224 that prevent that cigarette roller 1200 from rolling when on a flat surface. In the closed configuration, an opening 1225 is formed by the first roller holder 1201 and the second roller holder 1202. The opening 1225 provides entry for wrapping material, such as paper 131 shown in FIG. 15, into the cigarette roller 1200 during cigarette rolling operation.

Figure 27:
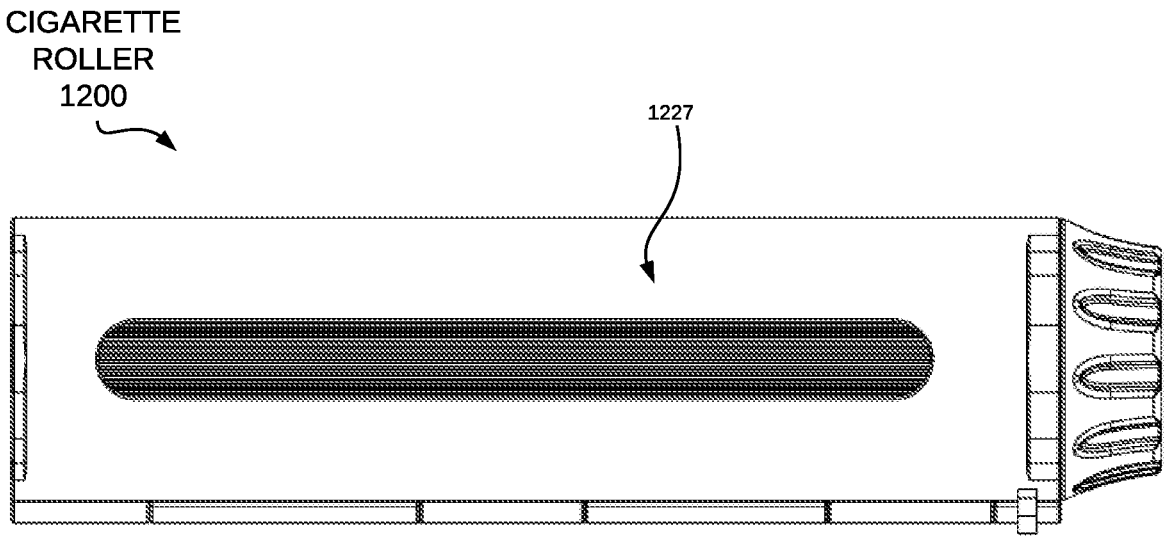
FIG. 27 is a diagram showing a bottom view of the cigarette roller 1200 in the closed configuration.

FIG. 27 is a diagram showing a bottom view of the cigarette roller 1200 in the closed configuration. An opening 1227 is provided for material to exit the cigarette roller 1200 during cigarette rolling operation.

Figure 28:
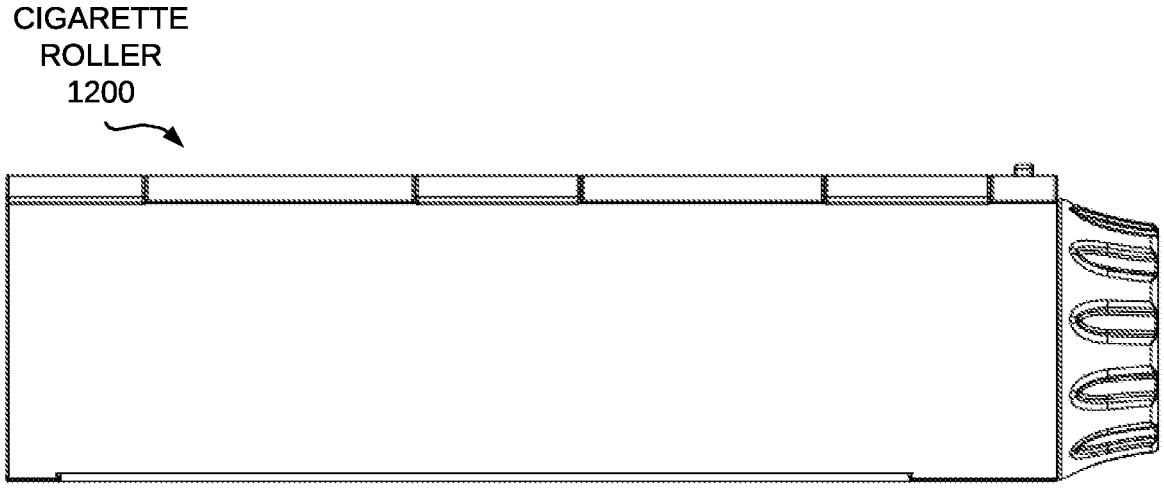
FIG. 28 is a diagram showing a top view of the cigarette roller 1200 in the closed configuration.

FIG. 28 is a diagram showing a top view of the cigarette roller 1200 in the closed configuration.

Figure 29:
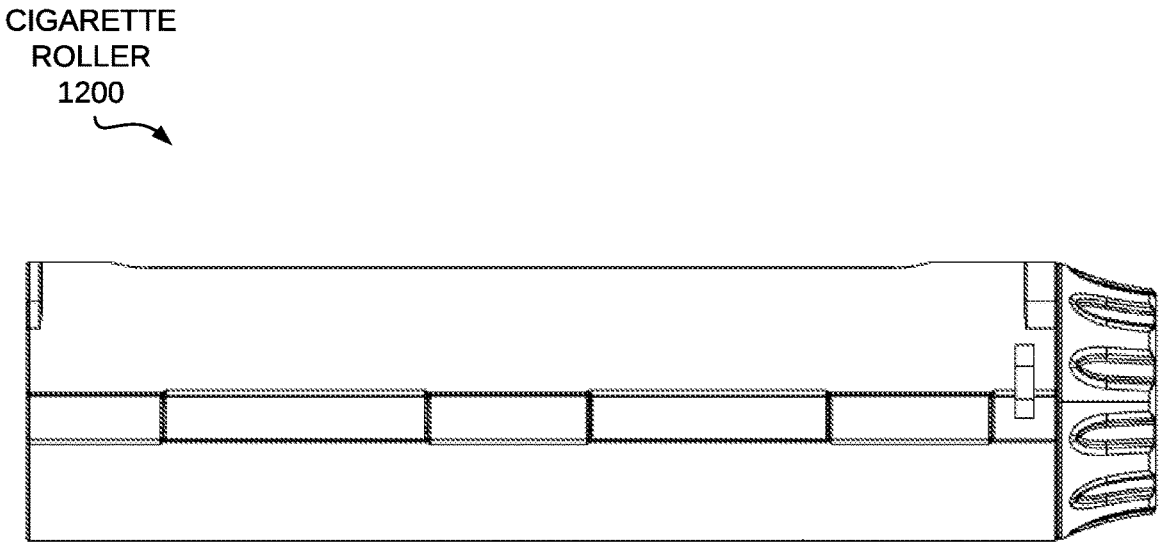
FIG. 29 is a diagram showing a left side view of the cigarette roller 1200 in the closed configuration.

FIG. 29 is a diagram showing a left side view of the cigarette roller 1200 in the closed configuration.

Figure 30:
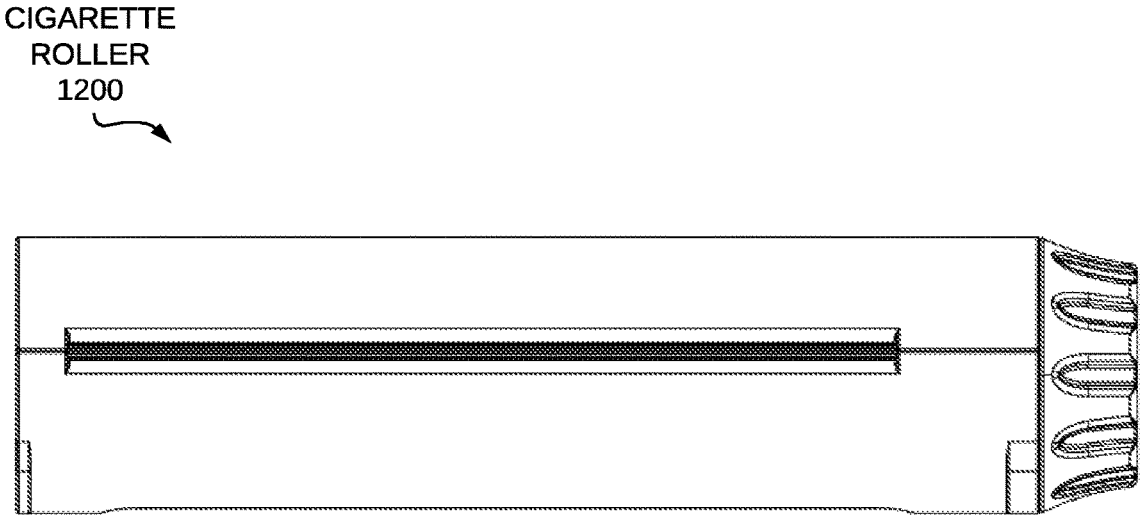
FIG. 30 is a diagram showing a right side view of the cigarette roller 1200 in the closed configuration.

FIG. 30 is a diagram showing a right side view of the cigarette roller 1200 in the closed configuration.

Figure 31:
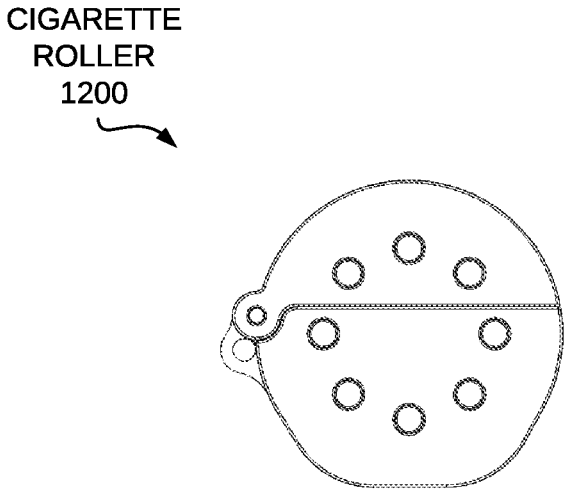
FIG. 31 is a diagram showing a back end view of the cigarette roller 1200 in the closed configuration.

FIG. 31 is a diagram showing a back end view of the cigarette roller 1200 in the closed configuration.

Figure 32:
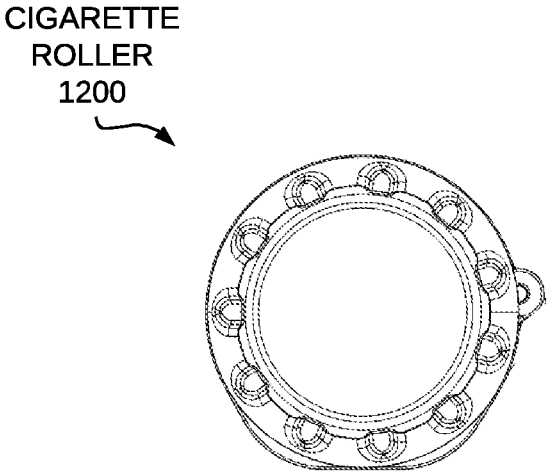
FIG. 32 is a diagram showing a front end view of the cigarette roller 1200 in the closed configuration.

FIG. 32 is a diagram showing a front end view of the cigarette roller 1200 in the closed configuration.

Figure 33:
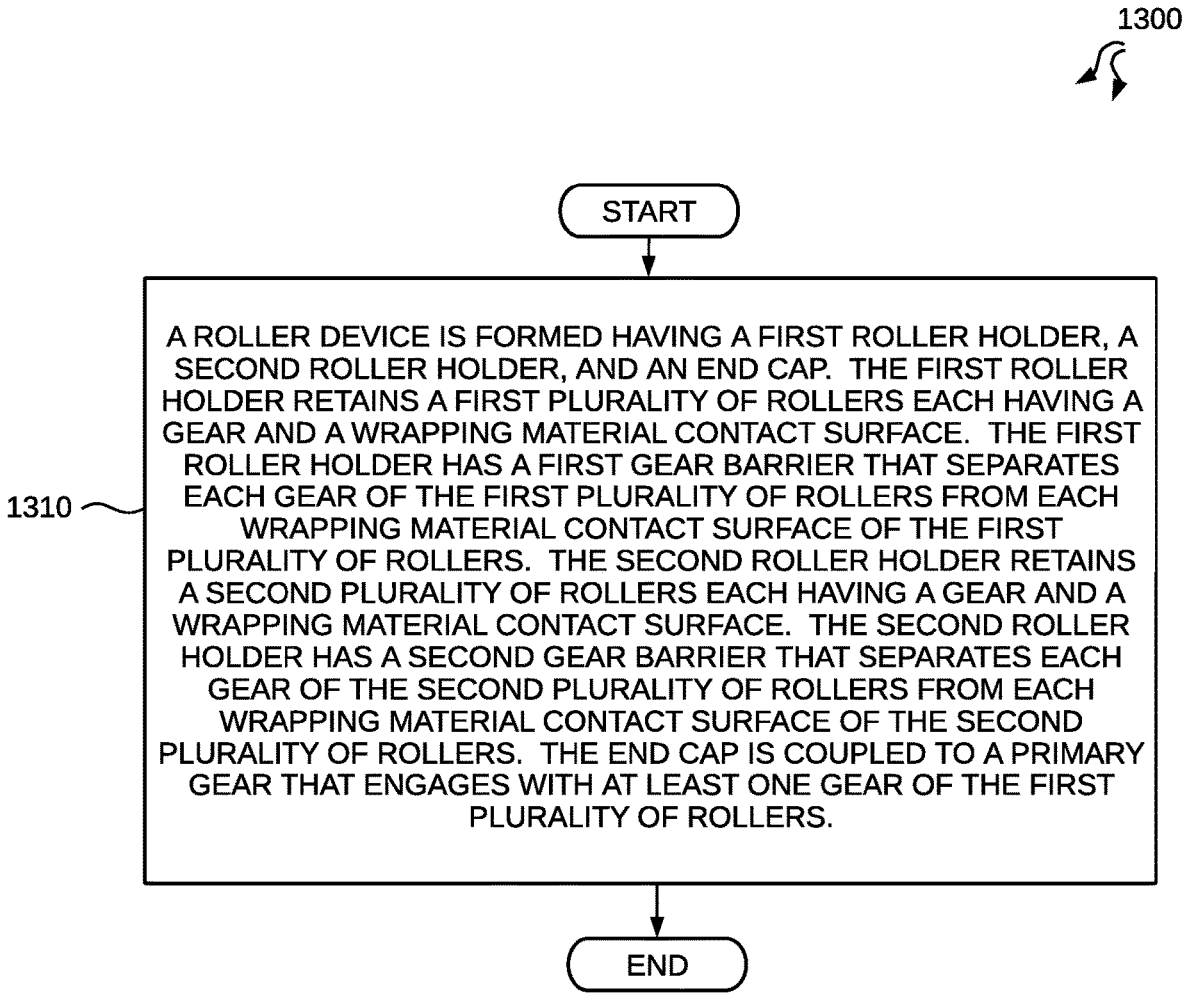
FIG. 33 is a flowchart of a method 1300 of manufacturing a novel cigarette roller.

FIG. 33 is a flowchart of a method 1300 of manufacturing the novel cigarette roller 1200. In a first step (step 1310), a roller device is formed having a first roller holder, a second roller holder, and an end cap. The first roller holder retains a first plurality of rollers each having a gear and a wrapping material contact surface. The first roller holder has a first gear barrier that separates each gear of the first plurality of rollers from each wrapping material contact surface of the first plurality of rollers. The second roller holder retains a second plurality of rollers each having a gear and a wrapping material contact surface. The second roller holder has a second gear barrier that separates each gear of the second plurality of rollers from each wrapping material contact surface of the second plurality of rollers. The end cap is coupled to a primary gear that engages with at least one gear of the first plurality of rollers.

Figure 34:
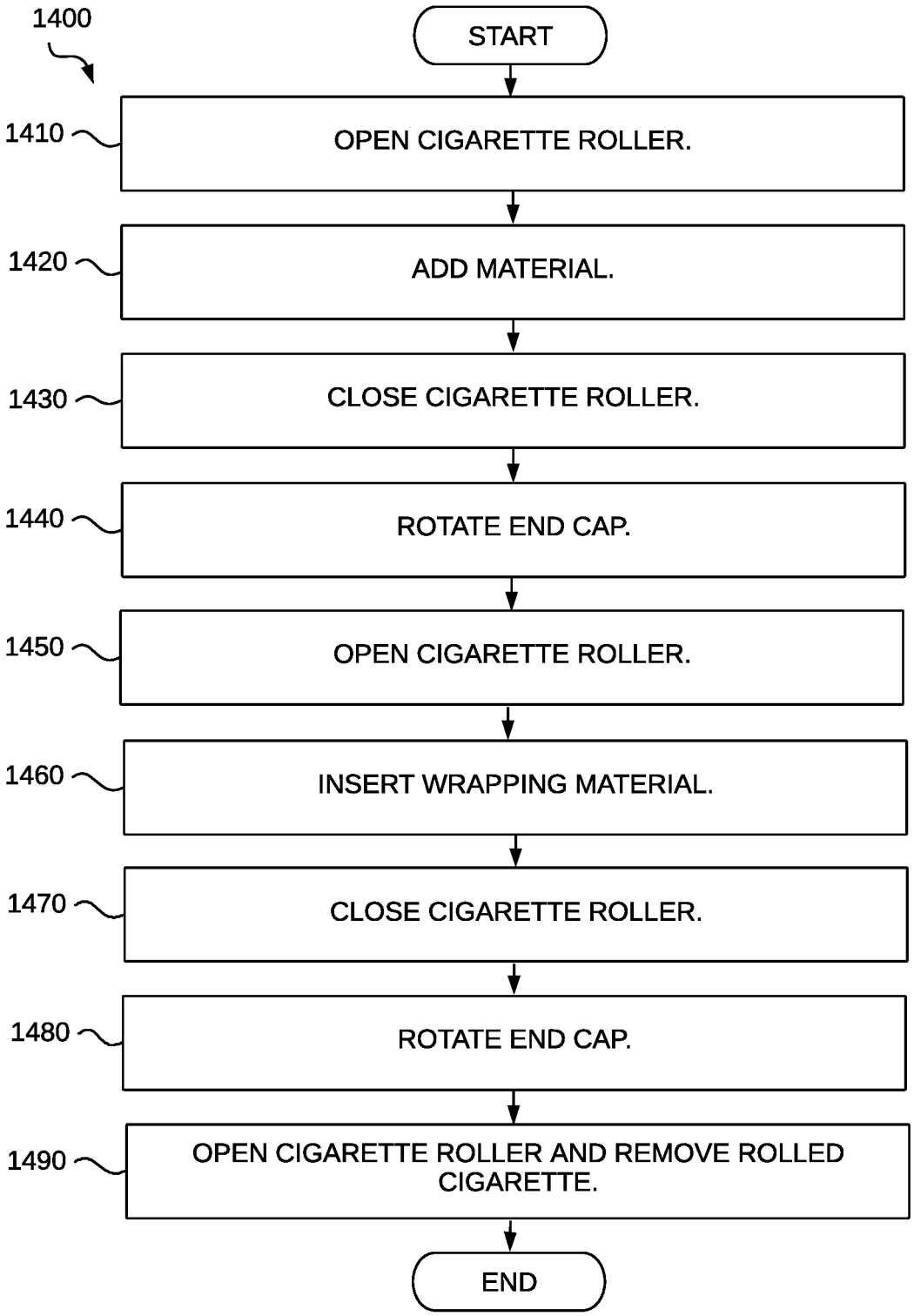
FIG. 34 is a flowchart of a method 1400 of rolling a cigarette using the novel cigarette roller.

FIG. 34 is a flowchart of a method 1400 of using the novel cigarette roller 1200. In a first step (1410), the cigarette roller 1200 is opened. For example, cigarette roller 1200 is opened as shown in FIG. 24.

In a second step (1420), material is added into the cigarette roller. Material includes any suitable smoking material for a cigarette. For example, smoking material 130, shown in FIG. 12, is added into the cigarette roller 1200.

In a third step (1430), the cigarette roller 1200 is closed. For example, cigarette roller 1200 is closed as shown in FIG. 26.

In a fourth step (1440), the end cap 1204 is rotated. For example, a hand 137 rotates the end cap 1204 while the cigarette roller 1200 is closed as shown in FIG. 14.

In a fifth step (1450), the cigarette roller 1200 is opened. For example, cigarette roller 1200 is opened as shown in FIG. 26.

In a sixth step (1460), the wrapping material 131 is inserted into the cigarette roller 1200. For example, wrapping material 131 is inserted as shown in FIG. 15.

In a seventh step (1470), the cigarette roller 1200 is closed. For example, cigarette roller 1200 is closed as shown in FIG. 26.

In an eighth step (1480), the end cap 1204 is rotated. For example, hand 137 rotates the end cap 1204 while the cigarette holder 1200 is closed as shown in FIG. 14.

In a ninth step (1490), the cigarette roller 1200 is opened and a rolled cigarette 132 is removed. For example, cigarette 132 is removed from the open cigarette roller 1200 as shown in FIG. 18.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a first roller holder having a first gear barrier, wherein the first roller holder retains a first plurality of rollers, wherein each of the first plurality of rollers has a non-slip surface and a gear, and wherein the first gear barrier is disposed between each non-slip surface and gear of the first plurality of rollers;

a second roller holder having a second gear barrier, wherein the second roller holder retains a second plurality of rollers, wherein each of the second plurality of rollers has a non-slip surface and a gear, and wherein the second gear barrier is disposed between each non-slip surface and gear of the second plurality of rollers; and an end cap, wherein the end cap is attached to an end of the first roller holder, wherein the end cap is coupled to a primary gear that engages with at least one gear of the first plurality of rollers.

2. The apparatus of claim 1, wherein the first roller holder and second roller holder rotate into an open position and closed position about a hinge.

3. The apparatus of claim 2, wherein in the closed position, a magnet of the first roller holder engages with a magnet of the second roller holder.

4. The apparatus of claim 1, wherein the primary gear engages with at least one gear of the second plurality of rollers.

5. The apparatus of claim 1, wherein the end cap attaches to the first roller holder via an opening of the first gear barrier.

6. The apparatus of claim 1, wherein rotating the end cap engages the primary gear, and wherein the end cap does not retract towards or extend away from the first roller holder.

7. The apparatus of claim 1, wherein the apparatus does not include a spring.

8. The apparatus of claim 1, wherein the first gear barrier has a first contour, wherein the second gear gear barrier has a second contour, and wherein the first contour and second contour fit together to form a barrier when the apparatus is in a closed configuration.

9. The apparatus of claim 1, wherein each of the first plurality of rollers has a portion that extends through an opening of the first gear barrier, and wherein each of the second plurality of rollers has a portion that extends through an opening of the second gear barrier.

10. A method comprising:

forming a roller device having a first roller holder, a second roller holder, and an end cap, wherein the first roller holder retains a first plurality of rollers each having a gear and a wrapping material contact surface, wherein the first roller holder has a first gear barrier that separates each gear of the first plurality of rollers from each wrapping material contact surface of the first plurality of rollers, wherein the second roller holder retains a second plurality of rollers each having a gear and a wrapping material contact surface, wherein the second roller holder has a second gear barrier that separates each gear of the second plurality of rollers from each wrapping material contact surface of the second plurality of rollers, and wherein the end cap is coupled to a primary gear that engages with at least one gear of the first plurality of rollers.

11. The method of claim 10, wherein the first roller holder and second roller holder rotate about a hinge into an open position or a closed position.

12. The method of claim 11, wherein in the closed position, a magnet of the first roller holder engages with a magnet of the second roller holder.

13. The method of claim 10, wherein the primary gear engages with at least one gear of the second plurality of rollers.

14. The method of claim 10, wherein the end cap attaches to the first roller holder via an opening of the first gear barrier.

15. The method of claim 10, wherein rotating the end cap engages the primary gear, and wherein the end cap does not retract towards or extend away from the first roller holder.

16. The method of claim 10, wherein the apparatus does not include a spring.

17. The method of claim 10, wherein the first gear barrier has a first contour, wherein the second gear gear barrier has a second contour, and wherein the first contour and second contour fit together to form a barrier when the roller device is in a closed configuration.

18. The method of claim 10, wherein each of the first plurality of rollers has a portion that extends through an opening of the first gear barrier, and wherein each of the second plurality of rollers has a portion that extends through an opening of the second gear barrier.

19. A cigarette roller comprising:

a hinge that rotatably attaches a first roller holder and a second roller holder, wherein the first roller holder retains a first plurality of rollers, wherein the first roller holder has a first gear barrier that separates gears of the first plurality of rollers from non-slip surfaces of the first plurality of rollers, wherein the second roller holder retains a second plurality of rollers, wherein the second roller holder has a second gear barrier that separates gears of the second plurality of rollers from non-slip surfaces of the second plurality of rollers; and means for engaging at least one gear of the first plurality of rollers.

20. The cigarette roller of claim 19, wherein the means for engaging is an end cap coupled to a primary gear.

* * * * *